United States Patent [19]

Tury et al.

[11] Patent Number: 4,667,692

[45] Date of Patent: May 26, 1987

[54] EXPANDABLE SOFT SIDE SHELTER

[75] Inventors: Keith A. Tury, DeLand; Ronald D. Evans, Orange City, both of Fla.

[73] Assignee: Brunswick Corporation, Skokie, Ill.

[21] Appl. No.: 525,001

[22] Filed: Aug. 19, 1983

Related U.S. Application Data

[63] Continuation-in-part of Ser. No. 410,521, Aug. 23, 1982, abandoned.

[51] Int. Cl.[4] ..... E04H 12/18; E04H 15/42; E04H 15/46

[52] U.S. Cl. ..... 135/105; 135/107; 135/DIG. 9; 52/109

[58] Field of Search ..... 135/97, 101, 102, 103, 135/104, 105, 110, 111, 115, 119, 120, DIG. 8, DIG. 9; 52/109, 108

[56] References Cited

U.S. PATENT DOCUMENTS

| | | | |
|---|---|---|---|
| 2,643,911 | 6/1953 | Lyon | 135/115 X |
| 2,797,696 | 7/1957 | Fritsche | 135/102 |
| 2,986,150 | 5/1961 | Torian | 135/119 X |
| 3,256,896 | 6/1966 | Cummins | 135/97 X |
| 3,424,179 | 1/1969 | Minot | 135/103 |
| 3,441,037 | 4/1969 | Transeau | 135/97 |
| 3,958,588 | 5/1976 | Huddle | 135/97 |
| 3,973,364 | 8/1976 | Seaman | 135/102 X |
| 4,078,572 | 3/1978 | Moss | 135/97 |
| 4,098,281 | 7/1978 | Bonfilio | 135/102 |
| 4,150,682 | 4/1979 | Ryce | 135/120 X |

FOREIGN PATENT DOCUMENTS

| | | | |
|---|---|---|---|
| 470241 | 8/1937 | United Kingdom | 135/109 |

*Primary Examiner*—Robert A. Hafer
*Assistant Examiner*—D. Neal Muir
*Attorney, Agent, or Firm*—William G. Lawler, Jr.; George J. Porter

[57] ABSTRACT

An expandable multi-purpose utility shelter (10), designed in several sizes, which is quickly erectable by two to six persons, depending upon the size of the shelter. The structure has a sturdy metal frame (12, 16) with a durable fabric cover attached to the inside of the frame. The frame (12, 16) comprises a series of ribs (12) which can be very quickly and easily extended from a compact folded configuration needed for easy transportation to a full-size shelter at erection. Adjacent ribs (12) are connected by a single reinforcing member (16) or by X-shaped reinforcing members (16a) on each side of the shelter. These reinforcing members serve as force transmitting means for opening and closing the shelter (10) and keeping adjacent ribs (12) stabilized and spaced equidistant. Individual reinforcing members are pivotally connected to the lower portion of one shelter leg and rollably or slideably connected to the upper portion of a next adjacent shelter leg. The ribs (12) are equipped with a plurality of sturdy hinges (24) which are designed to prevent the ribs (12) from folding when in the erected position and to prevent pinching and damaging the cover when the shelter is folded. The design of the shelter (10) also provides for securely connecting a plurality of shelters (10) butted together end-to-end or for grouping shelters (10) in complexes and for adding a fly cover (18) to the shelter (10) to insulate the shelter from direct sunlight. The invention also includes a method of erecting the apparatus and a method and arrangement for grouping shelters into a complex.

31 Claims, 56 Drawing Figures

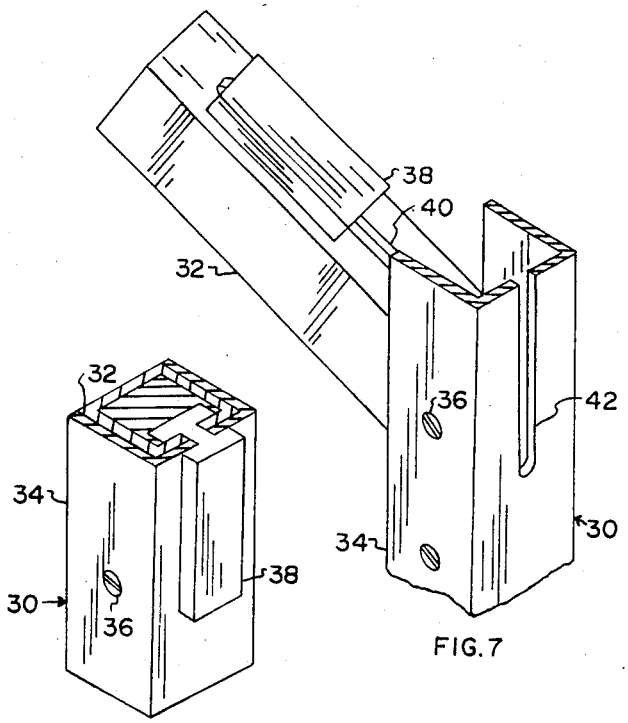
FIG. 7
FIG. 6
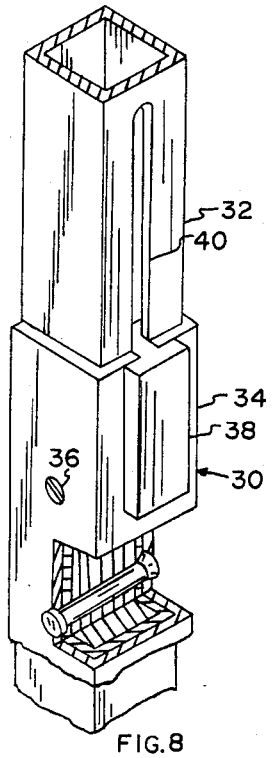
FIG. 8
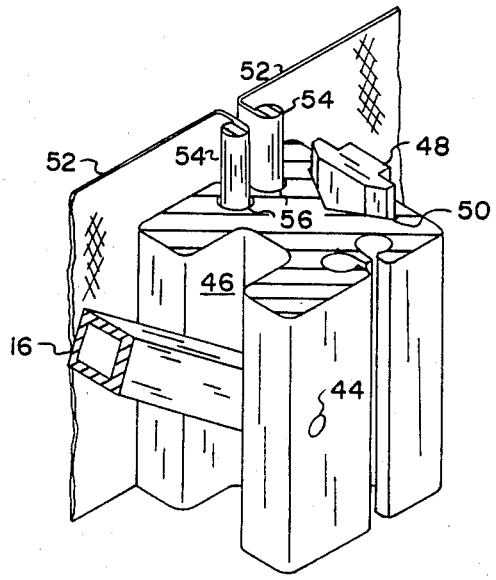
FIG. 9

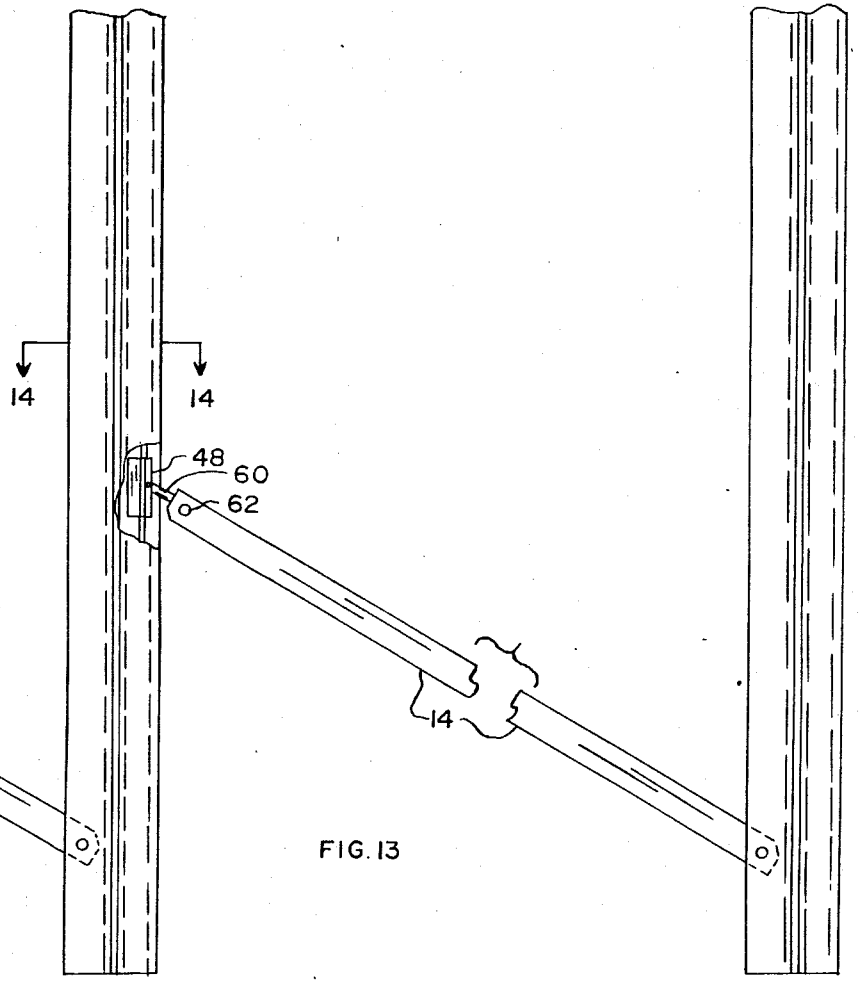
FIG. 13
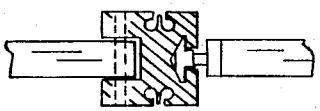
FIG. 14
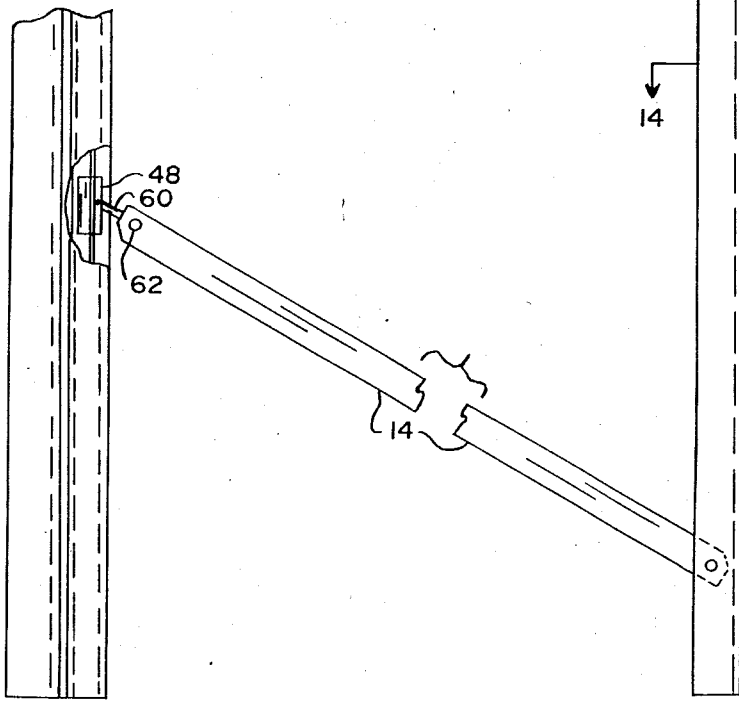

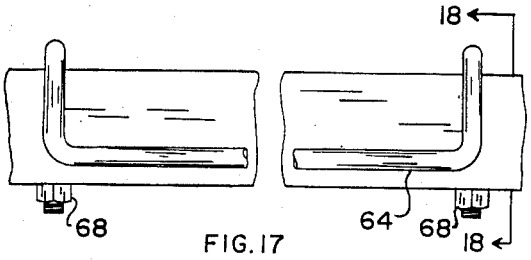
FIG. 17
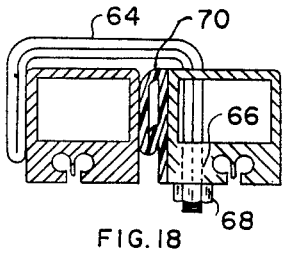
FIG. 18
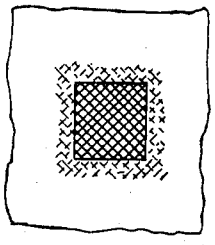
FIG. 19
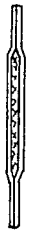
FIG. 20
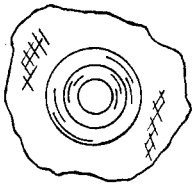
FIG. 21
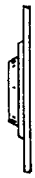
FIG. 22
FIG. 23
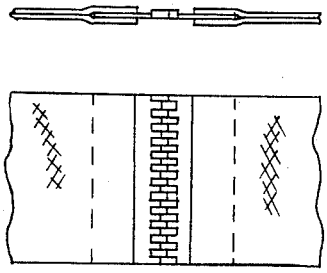
FIG. 24
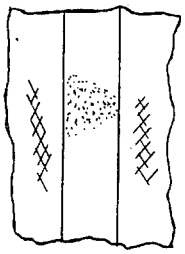
FIG. 25
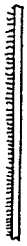
FIG. 26

EXPANDABLE SOFT SIDE SHELTER

CROSS REFERENCE TO RELATED APPLICATIONS

This application is a continuation-in-part of the copending application of Keith A. Tury and Ronald D. Evans, Ser. No. 6-410,521, "Expandable Soft Side Shelter," filed Aug. 23, 1982 now abandoned.

This application is related to U.S. patent application Ser. No. 6-480,230, "Expandable Shelter System Providing Collective Protection," filed Mar. 30, 1983.

TECHNICAL FIELD

The present invention relates generally to portable shelters, and more particularly to a metal frame soft side expandable shelter that is sturdy, self-contained, easily repairable, and quickly erectable and may serve as an all-purpose utility structure.

BACKGROUND OF THE INVENTION

In the past a wide variety of portable shelters have been used to include tents and similar structures, inflatable structures, geodesic domes, and various types of pre-fabricated structures. Tents have the advantage of being quick to erect while pre-fabricated structures have the advantage of being sturdier, more permanent, and more capable of withstanding weather. The ideal portable shelter would be quick and easy to erect, yet sturdy and capable of withstanding windy and stormy weather.

U.S. Pat. No. 3,256,896 to Phil F. Cummins was an improvement over some of the previously known portable shelters cited therein. However, the device disclosed and claimed by the Cummins patent has several disadvantages. Its framework was too heavy, its hinges and hardware had protrusions which could tear and damage the attached cover, and its cover was difficult to remove for the purpose of repair or replacement. The present application discloses a device which is an improvement over Cummins and is designed to overcome the disadvantages of the Cummins device. The present invention is designed to be lighter than the Cummins device, yet sturdy enough to remain serviceable over a long period of time. In addition, the present invention incorporates a number of features designed to make the invention easier to manufacture, more maintenance-free, and easier to repair. The advanced features and improvements of the present invention will be disclosed in detail hereinbelow.

Therefore, it is a general object of this invention to provide a lighter weight, sturdy, quickly erectable and strikable, easily repairable, all-purpose utility structure capable of being made in several sizes.

SUMMARY OF THE INVENTION

The present invention is suitable for a wide variety of recreational, military, and business uses wherever a sturdy yet quickly erectable portable shelter is needed. This shelter is., of course, eminently suitable to a large number of uses by the military services, including personnel quarters, command and administrative quarters, vehicle and weapons maintenance, storage of supplies, and for field hospitals. For large hospitals and higher military headquarters, a number of the units may be connected together to form complexes in a manner which will be disclosed fully below.

In accordance with the invention, there is provided an expandable utility structure comprising a support framework comprising a plurality of inverted U-shaped ribs, each rib having two legs and at least two hinges to permit the legs to be folded inwardly and the shelters to be folded into a compact package for storage and easy transportation. The framework also has a series of reinforcing members connecting and spacing the ribs, each reinforcing member being one single longitudinal member connected to two adjacent ribs. A second embodiment utilizes X-shaped reinforcing members connecting adjacent ribs. Each single reinforcing member and each individual member of an X-shaped reinforcing member is pivotally connected to the lower portion of one shelter leg and movably connected to the upper portion of a next adjacent shelter leg. The shelter further comprises a flexible cover removably secured to each rib member so that it pleats inwardly when the shelter is closed.

BRIEF DESCRIPTION OF THE DRAWINGS

A presently preferred embodiment of the invention will now be described in detail in connection with the accompanying drawings, wherein:

FIG. 6 shows an elevational view of an alternative (sliding) hinge (shown partially in section and in locked position) on a rib of the shelter frame.

FIG. 7 shows a view of the alternative sliding hinge of FIG. 6 (in an unlocked position).

FIG. 8 is an elevational view of the alternative sliding hinge of FIG. 6 in locked position with the hinge shown partially in cross section.

FIG. 9 is an elevational view of an aluminum extrusion rib showing how the two adjacent pieces of the fabric are attached to the rib and how the reinforcing members are attached to one side of the rib with a pivot pin and to the other side of the rib with a slide.

FIG. 13 is a side elevational view of the ribs and reinforcing members in partially extended configuration, shown partially in section.

FIG. 14 is a sectional view of the aluminum extrusion ribs taken along line 14—14 of FIG. 13.

FIG. 17 is an elevational view of the shelter connector assembly.

FIG. 18 is a sectional view of the connector assembly of FIG. 17 in latched position, with a weather seal.

FIG. 19 is a front view of a screen which is heat-sealed to the shelter.

FIG. 20 is a sectional view of the screen shown in FIG. 19.

FIG. 21 is a front view of a grommet installation.

FIG. 22 is a side view of the grommet installation shown in FIG. 21.

FIG. 23 is a side view of the zipper installation.

FIG. 24 is a top view of the zipper installation shown in FIG. 23.

FIG. 25 is a top view of a hook and pile installation.

FIG. 26 is a side view of the hook and pile installation shown in FIG. 25.

DETAILED DESCRIPTION OF THE INVENTION

Figures 1, 2:
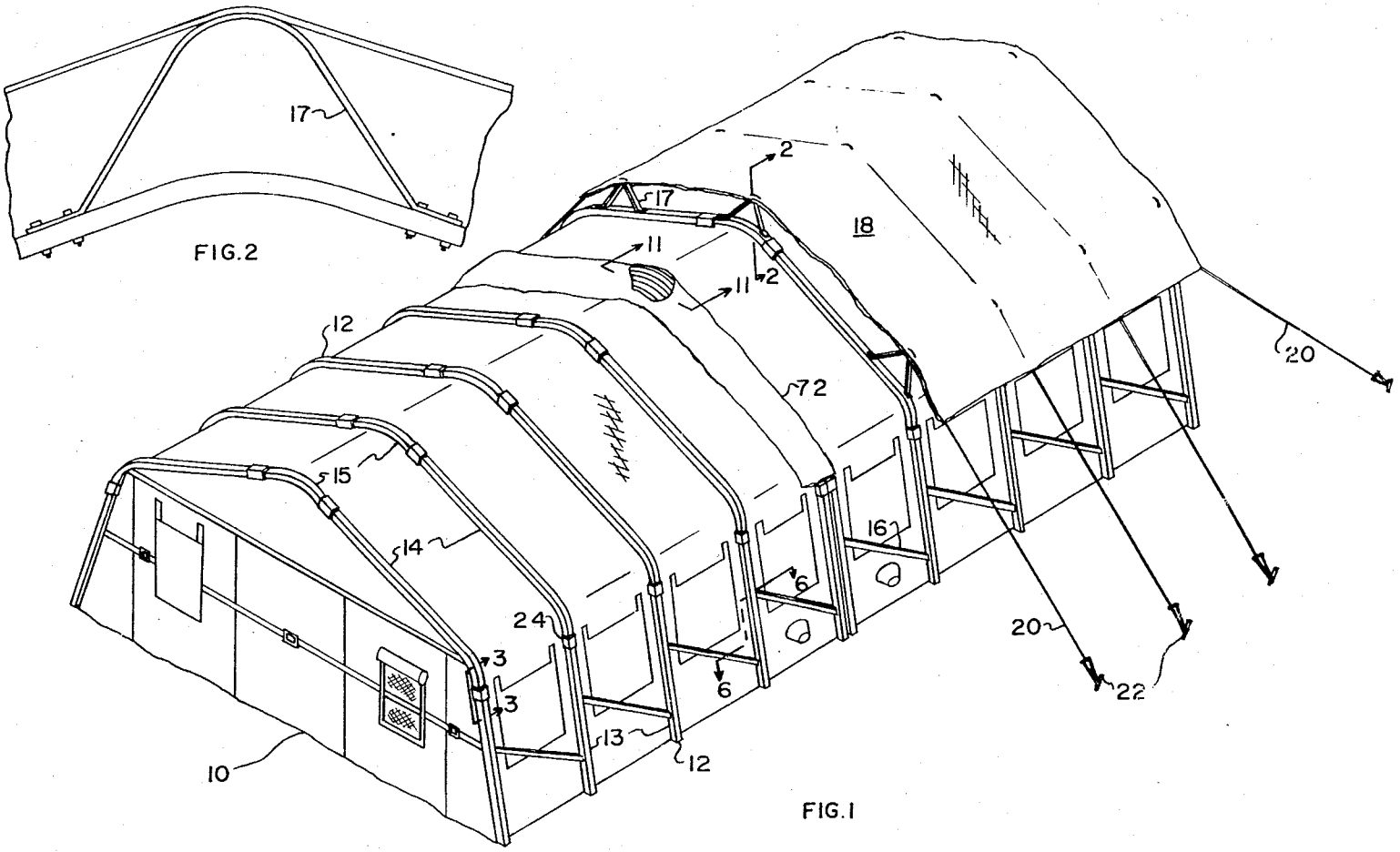
FIG. 1 is a pictorial illustration of the invention erected with a fly cover installed at the far end.
FIG. 2 is an elevational view of a ridge or eave extender for attaching a fly cover to the invention.
Figures 3A, 3B:
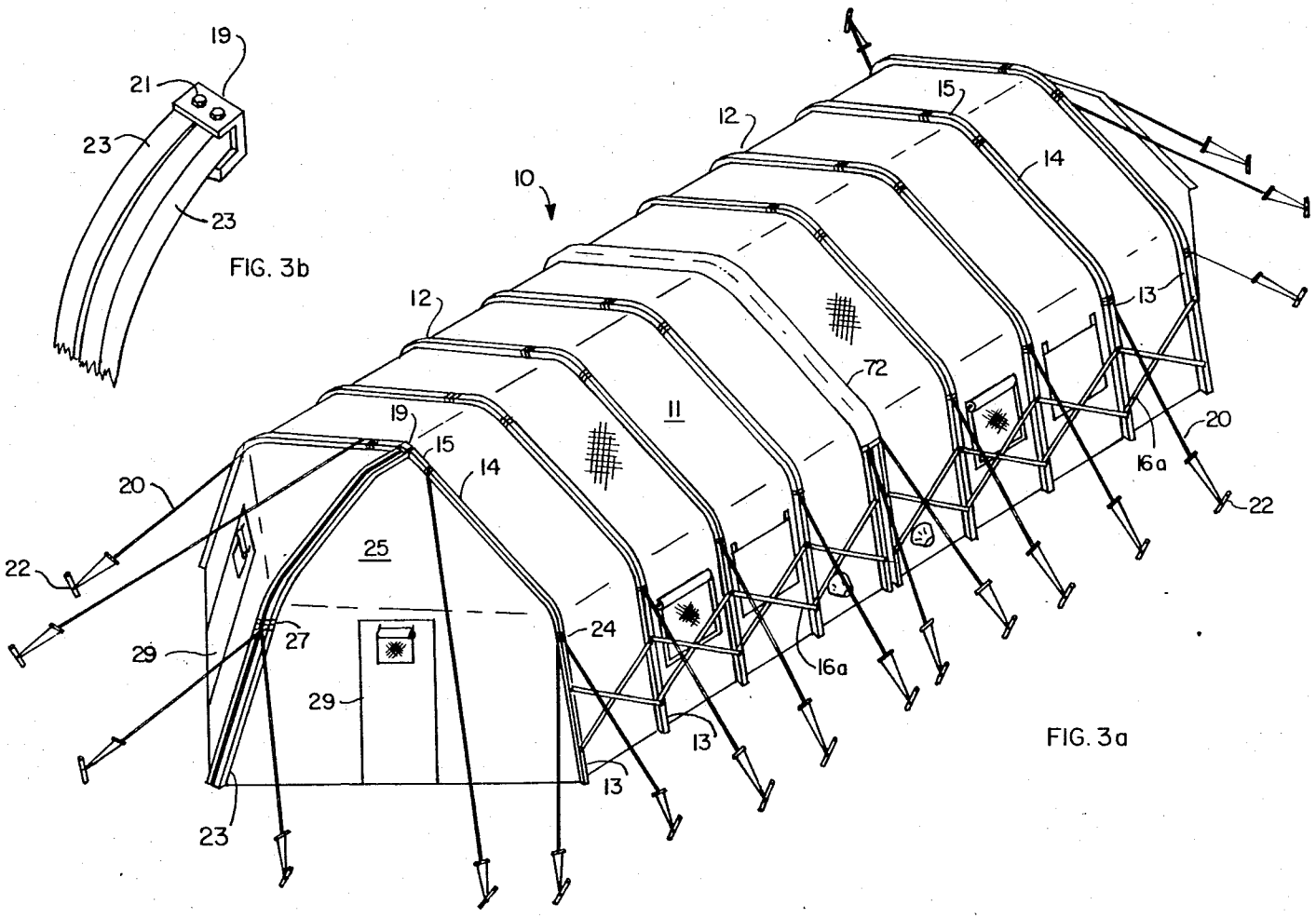
FIG. 3*a* is a pictorial illustration of an alternative embodiment of the invention equipped with a triangular vestibule on each end.
FIG. 3*b* is an elevational view showing details of the pivot for the shelter vestibule in erected position.
Figures 3C, 3D:
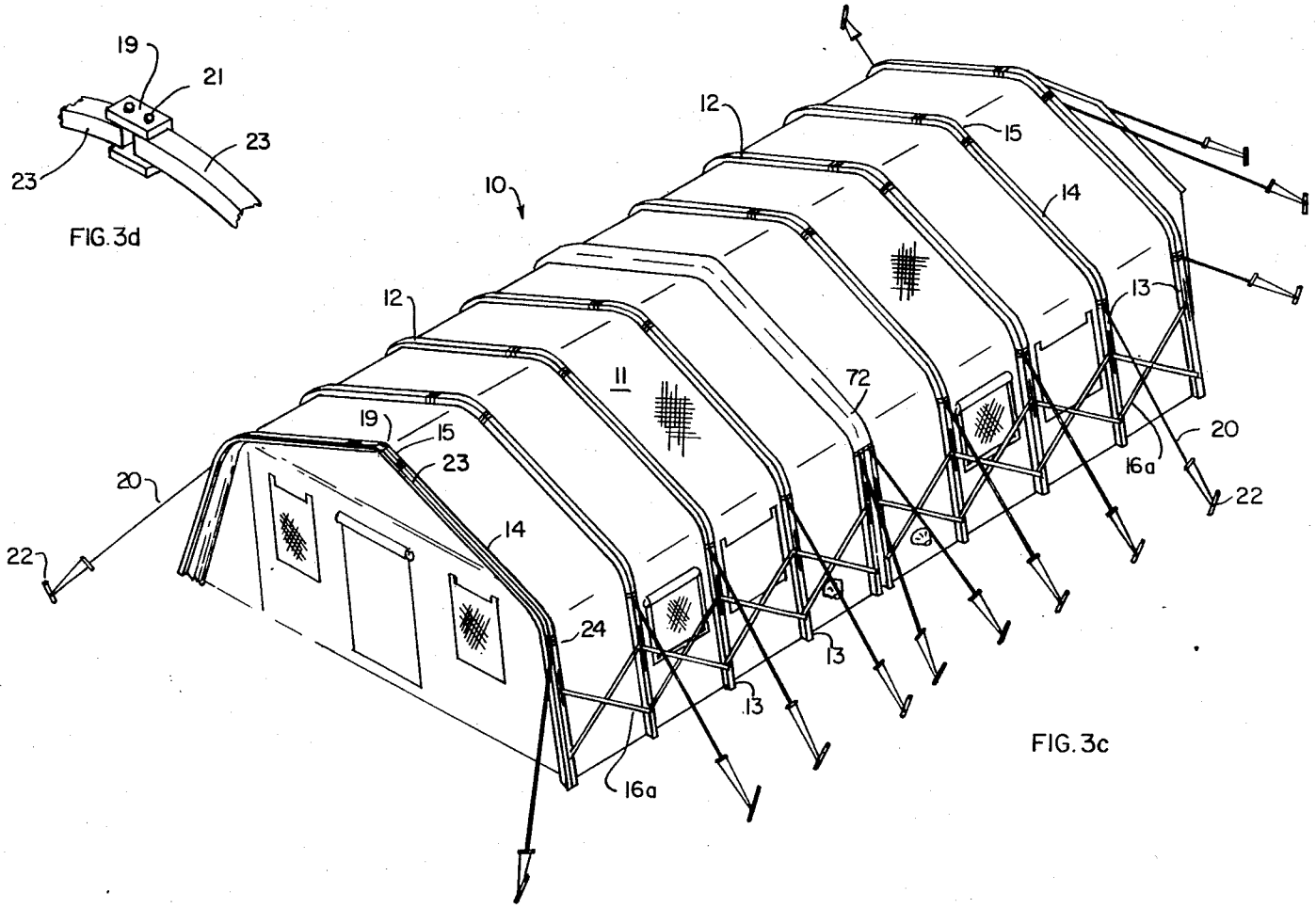
FIG. 3*c* is a pictorial illustration of the alternative embodiment of the invention shown in FIG. 3*a* with the triangular vestibule folded flat against the end of the shelter.
FIG. 3*d* is an elevational view showing details of the pivot for the shelter vestibule in the folded position.

FIG. 1 shows a preferred embodiment of the present invention, wherein a soft side shelter 10 comprises a durable fabric cover 11 and a plurality of channel-shaped rib members 12 constructed of a suitable light-weight, relatively high strength material, such as various aluminum alloys. Rib members 12 are in the preferred embodiment, rectangular in cross section for purposes of strength. However, it is to be understood that any suitable shape can be employed to meet specific requirements or conditions. Each rib 12, in the preferred embodiment, comprises two leg members 13, two arm members 14, and one top ridge member 15. Rib members 12 are equidistantly disposed longitudinally in a column. Adjacent rib members are interconnected and spaced on each side of the shelter by single reinforcing members 16 or by X-shaped reinforcing members or braces 16 as shown in FIGS. 3*a* and 3*c*.

Eave extenders 17, shown in FIGS. 1 and 2, are installed at several points along the top of ribs 12 in order that a fly cover 18 may be added quickly to the top of the shelter when desired. Fly cover 18 is guyed by guy ropes 20, which are attached to stakes 22.

The embodiment of the invention depicted in FIG. 1, while it is an excellent and useful portable shelter, may be further improved. As is obvious to those skilled in the art, the large flat ends of this embodiment of the shelter cause considerable wind resistance, especially in very high winds. To alleviate this condition and to improve the wind resistance characteristics of the shelter, a wind deflecting element was needed. FIG. 3*a* shows a further improved version of the shelter of FIG. 1 having a triangular vestibule 25 added at either end. Vestibule rib members 23 are pivoted at the top of the ridge member 15 located at the end of shelter 10. FIG. 3*b* shows the U-shaped vestibule pivot 19 having pivot pins 21 which hold vestibule rib members 23. As may be seen in FIG. 3*a*, pivot 19 is attached directly to the top of ridge member 15. FIG. 3*c* shows the vestibule in folded position. FIG. 3*d* shows details of pivot 19 in folded position. Thus, FIGS. 3*a* to 3*d* disclose a vestibule 25 having two swinging triangular-shaped halves which fold out and latch to make the shelter more wind resistant, yet can fold up compactly with the rest of the shelter. As shown in FIGS. 3*a* and 3*c*, side reinforcing members may be the X-shaped members 16*a* or they may be the single reinforcing members 16 as shown in FIG. 1. Whether the reinforcing members are the X-shaped type or the single-member type, they are preferably fabricated of aluminum, steel, or fiberglas pultrusions.

In addition to the improvement in wind resistance discussed above for the modified shelter of FIGS. 3*a–d*, the vestibule makes the shelter ideal for use under black-out conditions. A person entering the vestibule may close the vestibule door before opening the inner door, thus insuring that no light from the shelter may be seen outside.

As may be seen in FIG. 3*a*, a latch 27 is provided to hold vestibule rib members 23 in the erected position. Vestibule doors 29 may be either soft fabric or may be hard wall doors attached by hinges or by pile fastener tape, as will be disclosed in more detail below.

Figure 4:
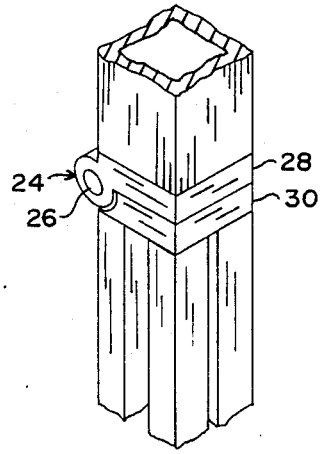
FIG. 4 is an elevational view of the cast hinge of the invention in the closed position.
Figure 5:
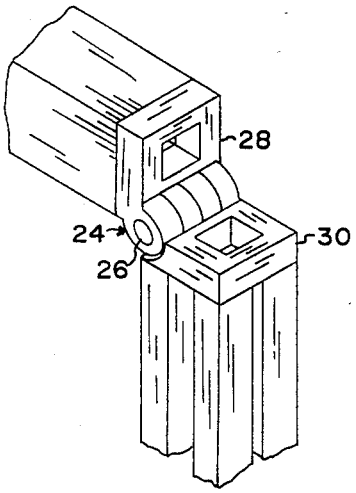
FIG. 5 is an elevational view of the cast hinge of FIG. 4 in the open position.

FIGS. 4 and 5 depict the aluminum cast hinge 24. This is a simple yet exceptionally sturdy hinge which allows very rapid and non-interruptive set-up for the shelter. In the preferred embodiment of the invention, ribs 12 (see FIG. 1) are hinged between the top member 15 and each arm member 14 as well as between each arm member 14 and the adjacent leg member 13. Thus, in the preferred embodiment, each rib member 12 has a total of four hinges 24.

Looking again at FIGS. 4 and 5, hinge 24 has a hinge pin 26 and two hinge leaves 28 and 30, which are identical. One casting functions to make both hinge leaves, thus eliminating left and right hand parts. As may be seen in FIG. 5, each hinge leaf has two substantially circular spaced projections attached to the leaf at an obtuse angle. Each projection has a circular opening to receive hinge pin 26. The projections of the two leaves together provide for aligned bearing surfaces to receive hinge pin 26.

Rib members 12 may also be equipped with an alternative type of hinges 30 which are on each side of the top of the ridge members and on each side of the arm members. As may be seen in FIGS. 6, 7, and 8, alternative hinges 30 are simple, rugged, and relatively foolproof. A section of extruded aluminum 32 having a square cross section fits into U-shaped hinge cover 34 and is pivoted around flat head bolt 36. The hinge can be latched by pivoting section 32 into hinge cover 34 and then moving slide latch 38 down both channels 40 in section 32 and channel 42 in hinge cover 34. Hinge 30 may be seen in the latched and unlatched configurations in FIGS. 6 and 7, respectively. FIG. 8 shows a latched hinge 30 with a portion of section 32 cut away to show the hinge in cross section. As shown in FIG. 6, slide 38 has an I-shaped cross section.

Looking now at FIG. 9, the elevational view of rib 12 shows how reinforcing members 16 are attached to ribs 12. Each reinforcing member 16 connects and spaces two adjacent ribs 12, one end of each reinforcing member 16 being pivoted from pin 44 through a fixed point on one rib and slidably connected to the adjacent rib 12. Pin 44 holds one end of each reinforcing member 16 in a fixed position in channel 46. FIG. 9 also shows how the movable end of each reinforcing member 16 is fastened to rib 12 by means of slide 48 moving vertically in channel 50.

As FIG. 9 also shows, shelter fabric section or panel 52 is connected to ribs 12 through beads 54 of polyester cord which slide into channels 56 in ribs 12. Fabric cover 11 (see FIG. 1) comprises a plurality of individual fabric sections or panels 52. Beads 54 allow the fabric section 52 to be removed from ribs 12 quickly and easily for repair or replacement and constitute a considerable improvement over riveting or other more permanent means of attachment of the fabric. In order to make the extruded aluminum sections of ribs 12 more versatile and usable on either side of the structure, ribs 12 are designed with double channels 56 on both sides of the ribs 12.

Figure 10:
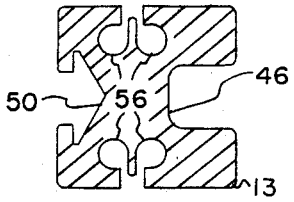
FIG. 10 is a cross-sectional view of an aluminum alloy extrusion of the type used in the leg section of the ribs of the invention.
Figure 11:
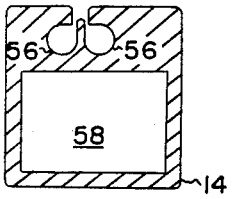
FIG. 11 is a cross-sectional view of an aluminum extrusion of the type used in the arm and top sections of the ribs of the invention.

FIGS. 10 and 11 show the cross-sectional areas of two types of aluminum extrusions used for ribs in the shelter. FIG. 10 shows the type of extrusion used in the legs 13 (FIGS. 1 and 3). As may also be seen in FIG. 9, this extrusion is equipped with a channel 46 which receives the fixed end of reinforcing members 16 and a channel 50 which receives slide 48 attached to the other end of reinforcing members 16. The two remaining sides of the extrusion each have double channels 56 for receiving polyester cord beads 54 which are each attached to one piece of the shelter fabric section 52.

FIG. 11 shows the type of extrusion used in the arms 14 and ridge members 15. This extrusion has double channels 56 on one side for receiving beads 54 and is closed on the other side with the hollow portion 58 inside to reduce the weight of the extrusion.

Figure 12:
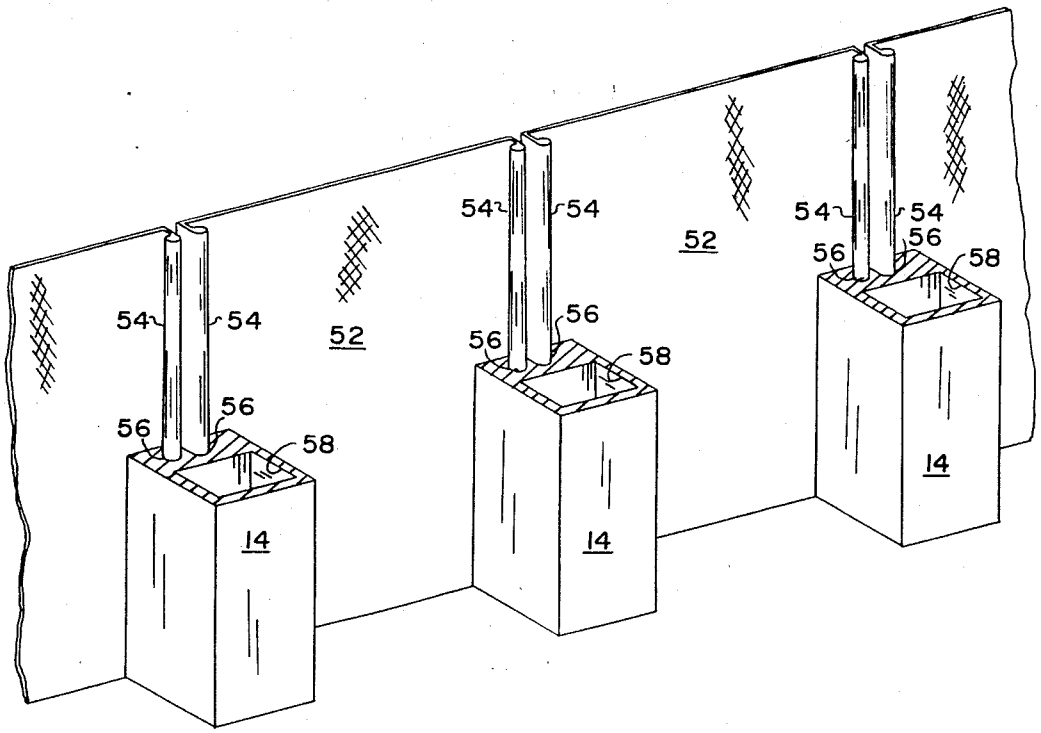
FIG. 12 is an elevational view showing how adjacent fabric panels are attached to adjacent ribs.

FIG. 12 shows several adjacent ribs utilizing the type of extrusion shown in FIG. 11. This drawing illustrates that adjacent panels of fabric 52 can easily be attached or detached individually or all together for repair or replacement.

Figure 16:
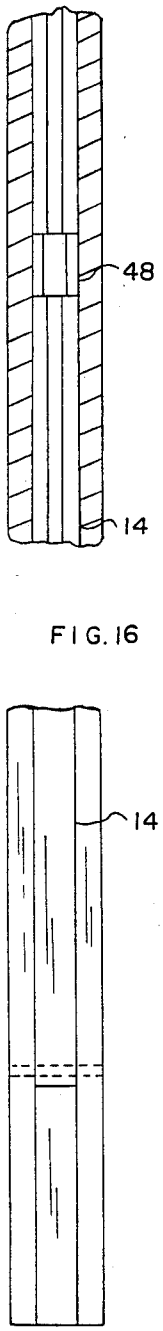
FIG. 16 is a sectional view of a rib of the framework taken along line 16—16 of FIG. 15.
Figure 15:
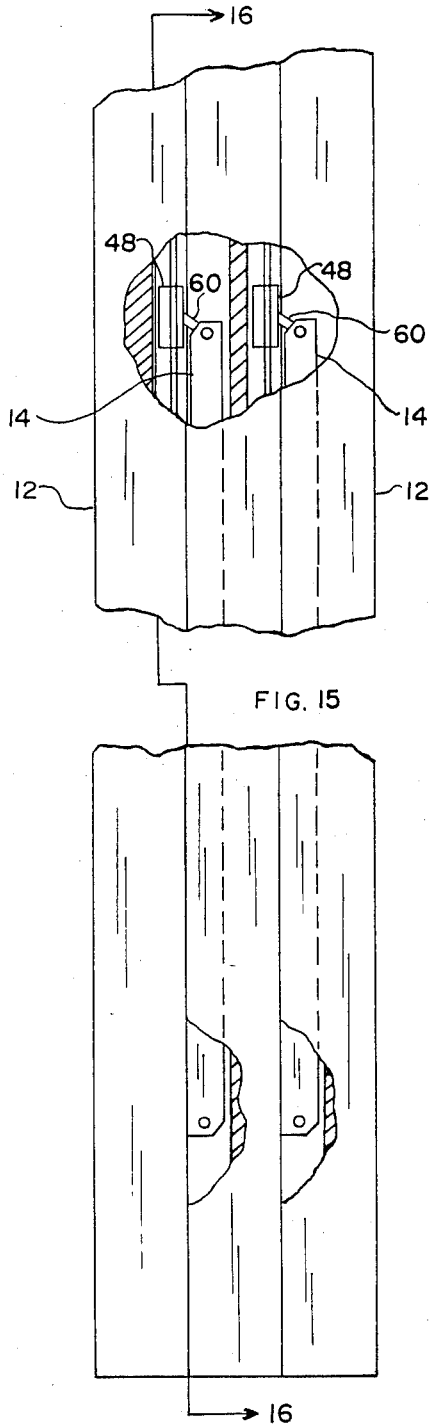
FIG. 15 is a side elevational view of the ribs and reinforcing members in closed configuration, shown partially in section.

Reinforcing members 16 are shown in greater detail in FIGS. 13 and 14. In these figures which show the reinforcing members 16 in the extended position, it may be seen that members 16 are pivoted from slides 48 and threaded stud 60 about pivot pin 62. FIGS. 15 and 16 show how ribs 12 abut each other when shelter 10 is in a folded position. In FIG. 15, it may be seen that when shelter 10 is folded, the long axis of reinforcing members 16 is substantially vertical and makes about a 60° angle with threaded, stud 60.

Looking now at FIGS. 17 and 18, shelter connector 64 was designed to solve the problem of securely connecting two shelters together after erection. This connector allows several shelters to be connected together with end-to-end connectors, eliminating a gap between the shelters. Shelter connector 64 is a U-shaped member having a portion 66 threaded on one side to receive a nut 68. Eight shelter connectors 64 are used to attach adjacent shelters 10 which are butted together end to end. Four of the connectors are attached to the end rib of one shelter and latch into position over the top of the end rib on the second shelter. Conversely, four more connectors are attached to the end rib of the second shelter and latch to the end rib of the first shelter. A total of four connectors are located on the ridge members, and four more connectors are located lower down on the arm members. A weather seal 70 makes the connection moisture-proof. A joint cover 72 (see FIG. 1) may also be used for additional protection.

FIGS. 19–26 illustrate how various accessories of the shelters, such as screens, grommets, zippers, and hook and pile fasteners, are heat-sealed to the shelter using a dielectric process. FIGS. 19 and 20 show how screens are installed into the fabric panels. FIGS. 21 and 22 illustrate grommet installation. FIGS. 23 and 24 illustrate zipper installation. FIGS. 25 and 26 illustrate hook and pile installation.

Figure 28:
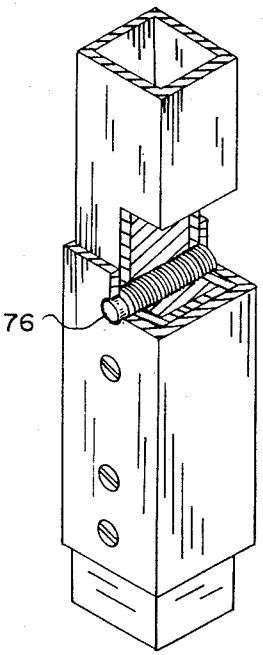
FIG. 28 is an elevational view showing the alternative hinge of FIG. 23 partially in section and in latched position.
Figure 27:
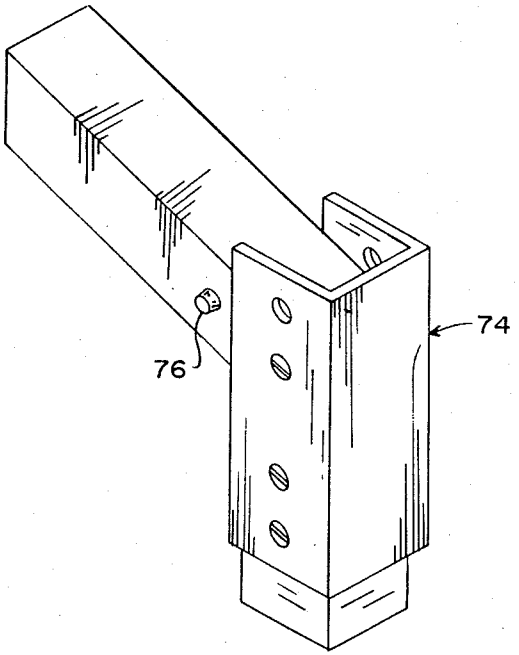
FIG. 27 is an elevational view of an alternative hinge using a spring plunger shown in folded position.

An alternative arrangement for cast hinges 24 is shown in FIGS. 27 and 28. Alternative hinge 74 uses a spring loaded plunger or detent 76 as a latch.

Figure 30:
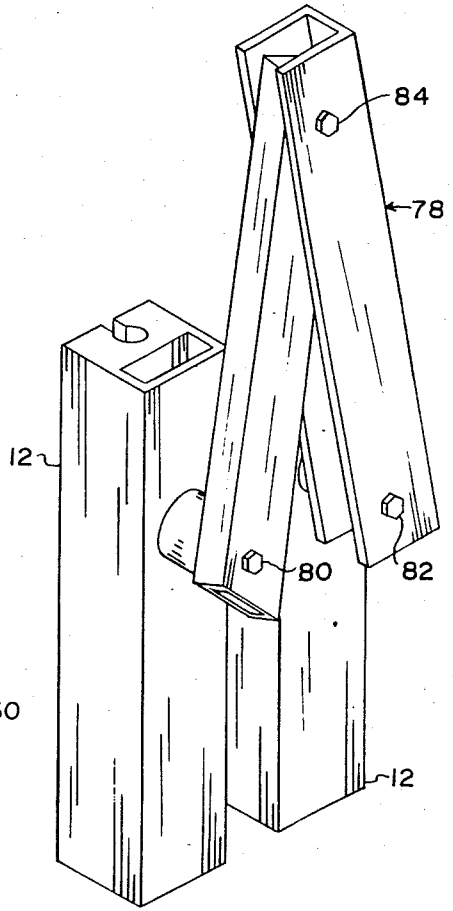
FIG. 30 is an elevational view of the alternative reinforcing member of FIG. 29 in unlocked (folded) position.
Figure 29:
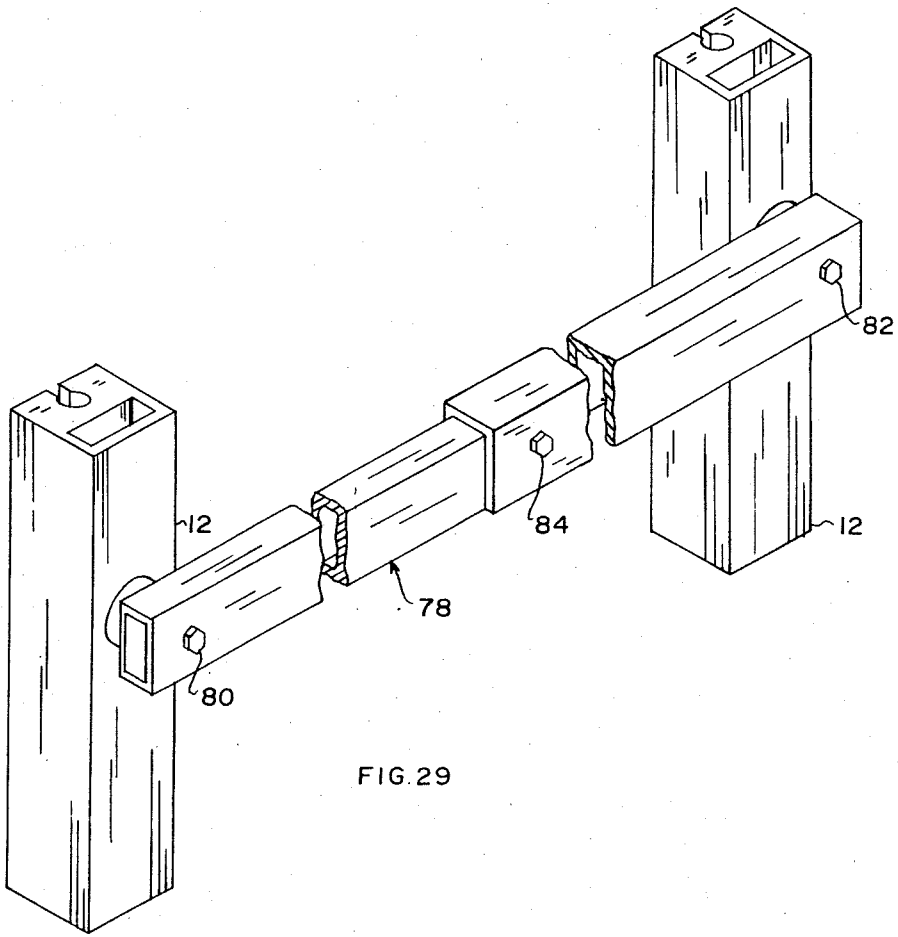
FIG. 29 is an elevational view of an alternative reinforcing member in locked (extended) position.

An alternative arrangement for reinforcing members 16 is shown in FIGS. 29 and 30. Reinforcing member 78 is fixed at both of its ends at pivot points 80 and 82. Member 78 is also pivoted in its center at pivot 84 and will fold about pivot 84 when shelter 10 is compressed or closed.

Figure 31:
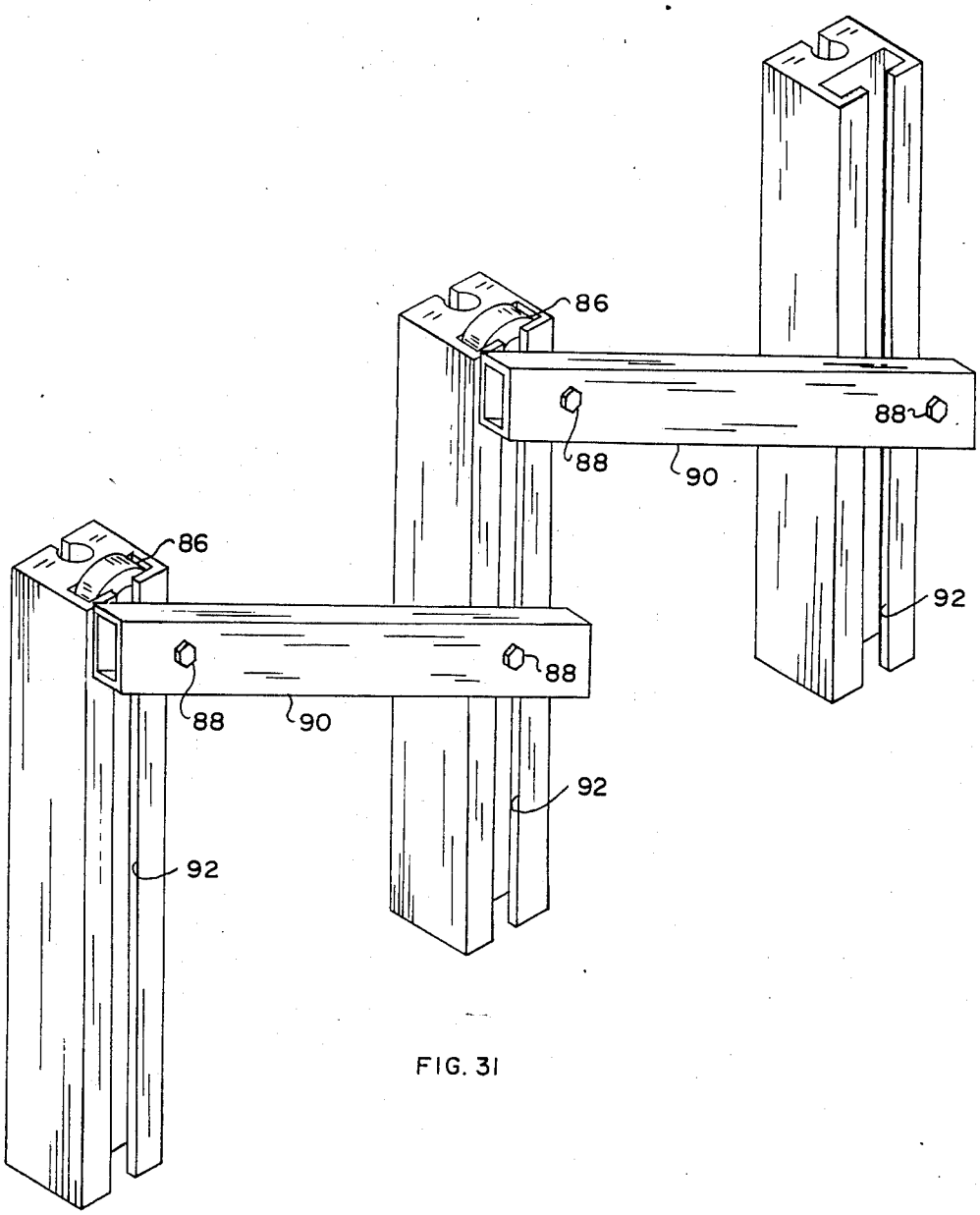
FIG. 31 is an elevational view showing an alternative arrangement for reinforcing members utilizing a rollar bar assembly.

FIG. 31 depicts a roller bar assembly which may be used as an alternative to the arrangement previously shown with the preferred embodiment in FIGS. 13 and 14 and designated by slide 48 attached to threaded stud 60. Roller 86 is attached by bolt 88 to alternate reinforcing member 90. Roller 86 rolls in channel 92.

FIGS. 32–40 inclusive show details of the frame of a small embodiment of shelter 10 (FIGS. 1, 3*a*, and 3*c*). Looking first at FIG. 32, there is shown a frame 101 for the small (20 feet × 11 feet) embodiment of the invention designated generally by the numeral 100 and having six ribs 102 and five X-shaped braces 104 connecting each adjacent pair of ribs 102. Ribs 102 on this small shelter 100 comprise an arch 106 attached by hinges 110 at each of its ends to a leg 108. Thus, arch 106 on this small embodiment of the shelter 100 corresponds to a ridge member 15 and two arms 14 on the larger embodiments of the shelter 10, and legs 108 on this shelter 100 correspond to legs 13 on shelter 10. Each X-brace 104 comprises two crossed elongated members, an inner member 104*a* which is close to legs 108 and an outer member 104*b* which is outside the inner member 104*a* and therefore spaced further from legs 108. The crossed members 104*a* and 104*b* are pivotally connected together at their midpoints 112. The lower end of each crossed member 104*a* and 104*b* is pivotally connected to the lower part of one leg 108, with its upper end movably connected to the upper end of a next adjacent leg 108. Thus, each pair of X-shaped braces 104 is operative to push the ribs 102 together in abutting relationship when the shelter 100 is closed (compressed) and to push them apart in spaced relationship when the shelter 100 is opened (extended).

Figure 33:
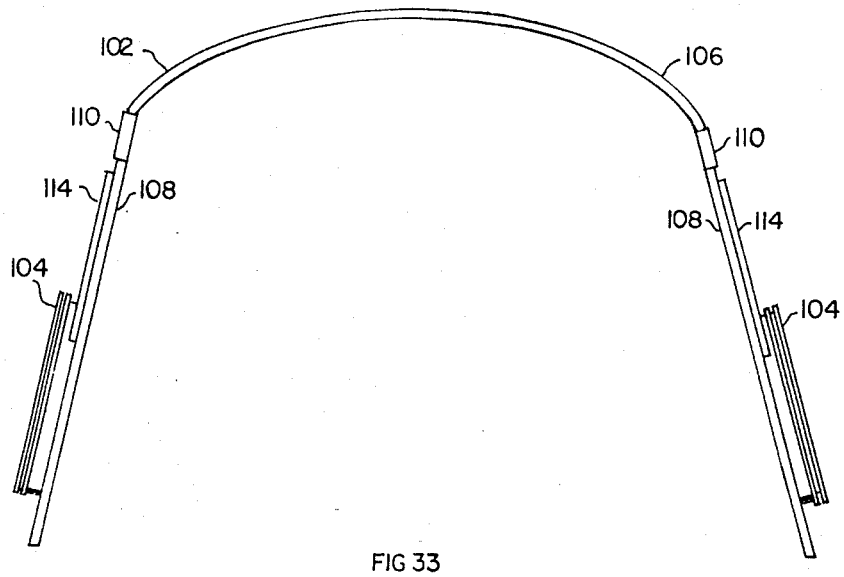
FIG. 33 is an end view of the small embodiment of the invention shown in FIG. 32.

FIG. 33 is an end view of frame 101 of small shelter 100. One rib 102 comprising arch 106. two legs 108, and two hinges 110 may be seen. X-shaped cross braces 104 are mounted on legs 108. In this view it may be clearly seen that long sections of channel 114 are attached directly to legs 108 and the upper ends of members 104*a* and 104*b* are in turn movably attached to channel 114.

Figure 34:
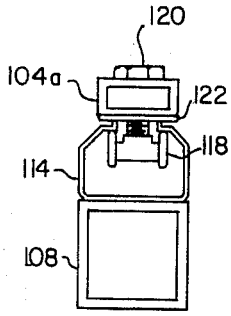
FIG. 34 is a cross-sectional view of the mount for the top end of an inner elongated member of an X-shaped brace connecting an end rib and its adjacent rib.

FIGS. 34–39 inclusive show cross-sectional views of several kinds of mounts used to attach X-braces 104 to legs 108 of ribs 102. FIG. 34 shows the mount, located at point 116 (FIG. 32), which supports the upper end of inner X-brace member 104*a*. Member 104*a* is rollably attached to slotted channel 114 which is attached to leg 108. Roller assembly 118 is firmly attached to member 104*a* with stud 120, thus allowing the upper end of member 104*a* to move downward when the frame 101 of shelter 100 is open (extended) and to move upward when frame 101 is closed (compressed). Spacer 122 between member 104*a* and channel 114 reduced friction between moving parts and protects the edges of the open slot in channel 114.

Figure 35:
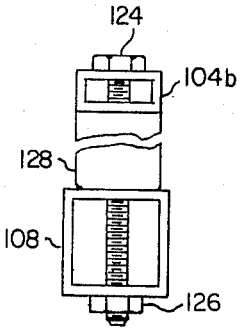
FIG. 35 is a cross-sectional view of the mount for the bottom end of an outer elongated member of an X-shaped brace connecting an end rib and its adjacent rib.

FIG. 35 shows the mount, located at point 118 (FIG. 32), which supports the lower end of outer X-brace member 104*b*. Member 104*b* is rotatably attached to leg 108 with bolt 124 and nut 126. A thick spacer 128 separates outer member 104*b* from leg 108 and holds member 104*b* the proper distance above leg 108.

Figure 32:
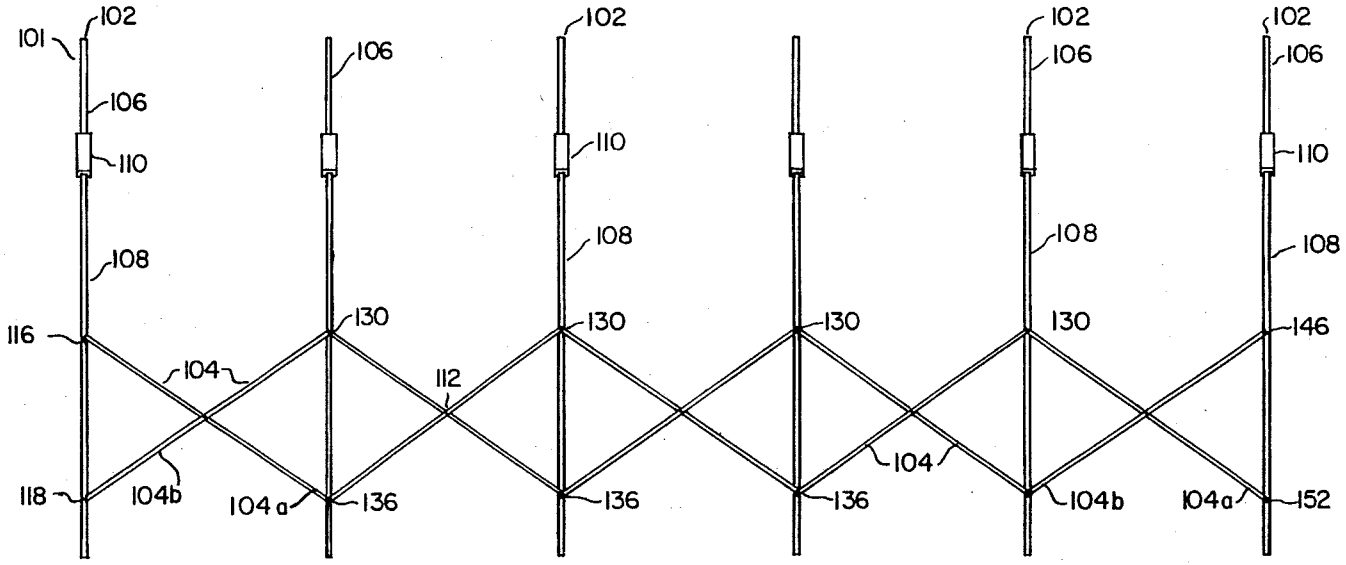
FIG. 32 is a side view of the framework for a small embodiment of the invention.
Figure 36:
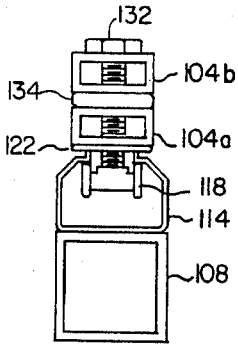
FIG. 36 is a cross-sectional view of the mount for the top ends of two elongated members of adjacent X-shaped braces, attached to an inner rib.

FIG. 36 shows the mount located at four points 130 (FIG. 32). This type mount supports the upper end of all the X-brace members, both 104*a* and 104*b*, which are attached to the four ribs 102 which are not on the ends of shelter 100. The mount of FIG. 36 is similar to the mount of FIG. 34 except that the top end of outer member 104*b*, as well as inner member 104*a*, is rollably attached to channel 114. Stud 132 fastens members 104*a* and 104*b* to roller assembly 118. As shown in FIG. 34, channel 114 is attached by a suitable method such as welding, to leg 108. Spacers 122 and 134 reduce friction and improve stability at pivot points.

Figure 37:
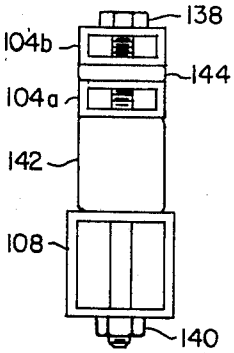
FIG. 37 is a cross-sectional view of the mount for the lower ends of two elongated members of adjacent X-shaped braces, attached to an inner rib.

FIG. 37 shows the mount located at four points 136 (FIG. 32). This type mount supports the lower ends of all the X-brace members, both 104*a* and 104*b*, which are attached to the four ribs 102 which are not on the ends of shelter 100. The mount of FIG. 37 is similar to the mount of FIG. 35 except that the bottom end of inner member 104*a*, as well as the bottom end of outer member 104*b*, is rotatably attached by bolt and nut 138 and 140 to leg 108. Spacer 142 holds members 104*a* and 104*b* the proper distance away from leg 108. Spacer 144 reduces friction at the pivot point between members 104*a* and 104*b*.

Figure 38:
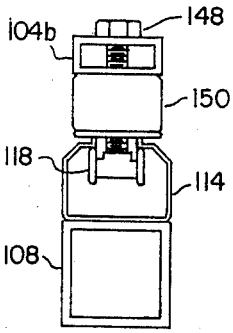
FIG. 38 is a cross-sectional view of the mount for the top end of an outer elongated member of an X-shaped brace connecting an end rib and its adjacent rib.

FIG. 38 shows the mount, located at point 146 (FIG. 32), which supports the upper end of outer X-brace member 104*b*. Member 104*b* is rollably attached to channel 114, which is attached to leg 108. Stud 148 holds member 104*b* attached to roller assembly 118. Spacer 150 holds member 104*b* the proper distance from channel 114 and leg 108.

Figure 39:
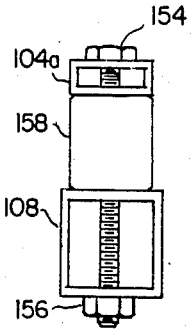
FIG. 39 is a cross-sectional view of the mount for the bottom end of an inner elongated member of an X-shaped brace connecting an end rib and its adjacent rib.

FIG. 39 shows the mount, located at point 152 (FIG. 32), which supports the lower end of inner X-brace member 104*a*. Member 104*a* is rotatably attached to leg 108 by bolt 154 and nut 156. A thick spacer 158 separates inner member 104*a* and leg 108 and holds member 104*a* the proper distance above leg 108.

Figure 40:
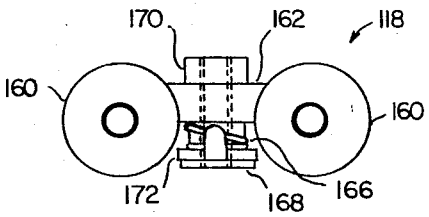
FIG. 40 is a side elevation view of a roller assembly for movably attaching the upper ends of the members of the X-shaped braces to the ribs.

FIG. 40 shows a side elevation view of the roller assembly 118 for rollably attaching the upper ends of X-braces 104*a* and 104*b* to the shelter ribs 102. End views of this assembly are shown in FIG. 34, FIG. 36, and FIG. 38. Roller assembly 118 has four wheels 160 attached to chassis 162. A spring-loaded vertical member 164 runs up through chassis 162 and is tapped out on the inside to receive a stud, such as 120 (FIG. 34), 132 (FIG. 36), or 148 (FIG. 38), all described above. Spring 166 is mounted on member 164 and is held in place by flange 168, which is part of member 164. Spacer 170 is mounted on the top part of member 164, while spacer 172 is mounted on the bottom part of member 164, above flange 168.

Figure 42:
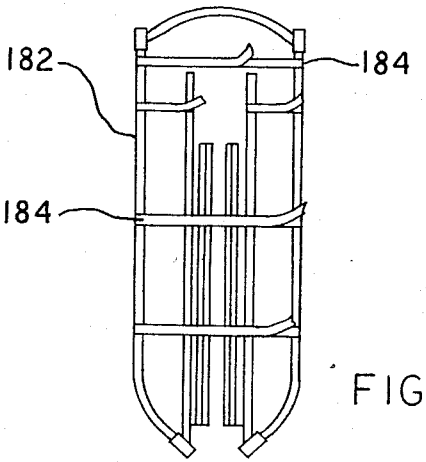
FIG. 42 is a plan view of the folded half-shelter lying on its side and held by webbing straps in position for packing.
Figure 41:
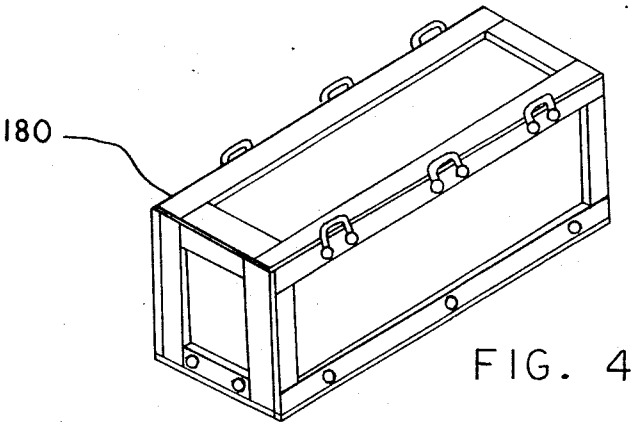
FIG. 41 is a perspective view of a shipping container accommodating a half-shelter for a large embodiment of the invention.
Figure 43B:
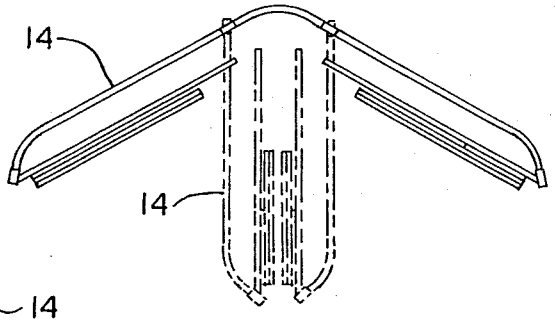
FIG. 43*b* is a plan view of the partially folded half-shelter lying on its side with the arms unfolded.
Figure 43C:
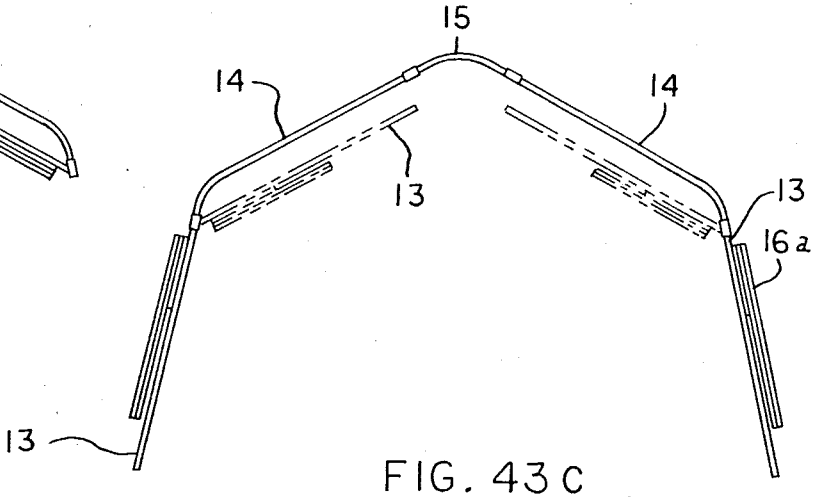
FIG. 43*c* is a plan view of the half-shelter lying on its side with both arms and legs unfolded to the fully extended position.
Figure 43A:
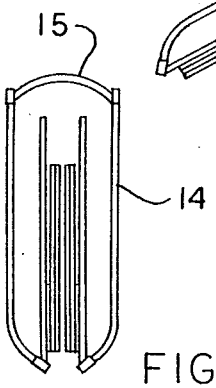
FIG. 43*a* is a plan view of the folded half-shelter of FIG. 42 with the webbing straps removed.

FIGS. 41–46 inclusive illustrate the steps in the method of erecting a large or medium sized shelter 10. FIG. 41 illustrates a shipping container 180 which houses a first half-shelter 182 in its packed configuration. This container 180 is opened and the folded half-shelter 182 removed. As shown in FIG. 42, the webbing straps 184 are removed from the half-shelter by depressing the buckle clamps and pulling the straps free. With the folded shelter 10 as shown in FIG. 43*a*, the shelter arms 14 are unfolded to the full extended position, as shown in FIG. 43*b*. Next the shelter legs 13 are unfolded to the full extended position, as shown in FIG. 43*c*.

Figure 44:
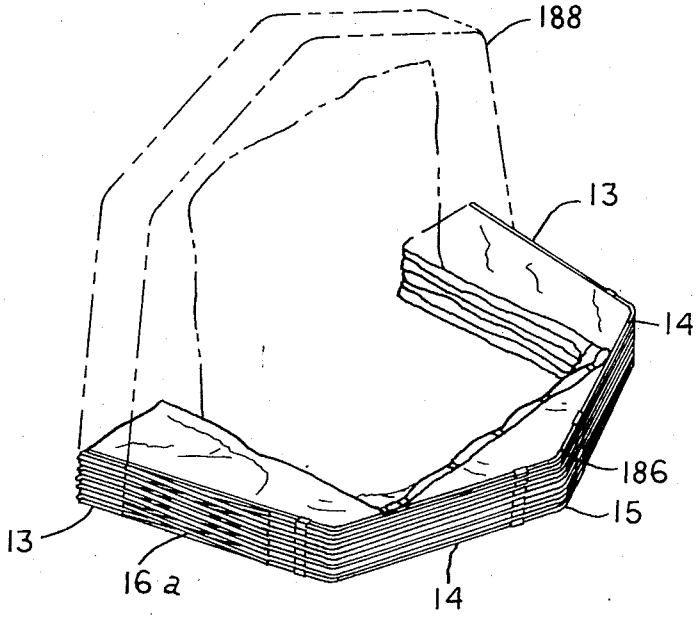
FIG. 44 is a perspective view of the half-shelter lying on its side with both arms and legs fully extended and ready to raise to the standing position.

As illustrated in FIG. 44, to raise the half-shelter, attach two of the longest guy lines to snap attachments located on the ridge member 15. With at least one person securing the guy ropes and at least one person on each side of the shelter frame, grasp the assembly above and below the lower hinge points. Then raise the shelter to a standing position, as shown in phantom at 188. At this time, start a short extension (18 to 24 inches) to stabilize the upright position.

Figure 45:
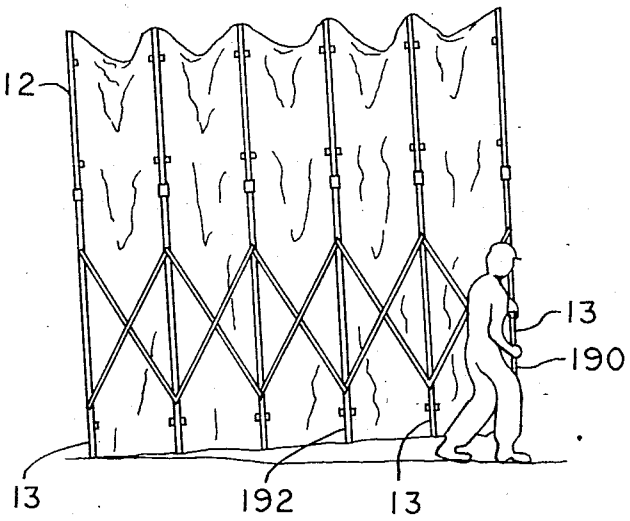
FIG. 45 is a side elevation of the standing half-shelter, shown being extended by at least one person on either side.

To extend the half-shelter 182 as shown in FIG. 45, two persons should be positioned on each side, one opposite the front leg 190 and one opposite the third leg 192. They should grasp the shelter legs 190 and 192 approximately 3 feet from the ground. Then lift and tilt the entire frame assembly back so that the legs 13 of only the rear rib 12 are touching the ground. Then, all together, all four persons should walk forward until the shelter is fully extended, being conscious that binding will result if one side is extended faster than the other.

Figure 46:
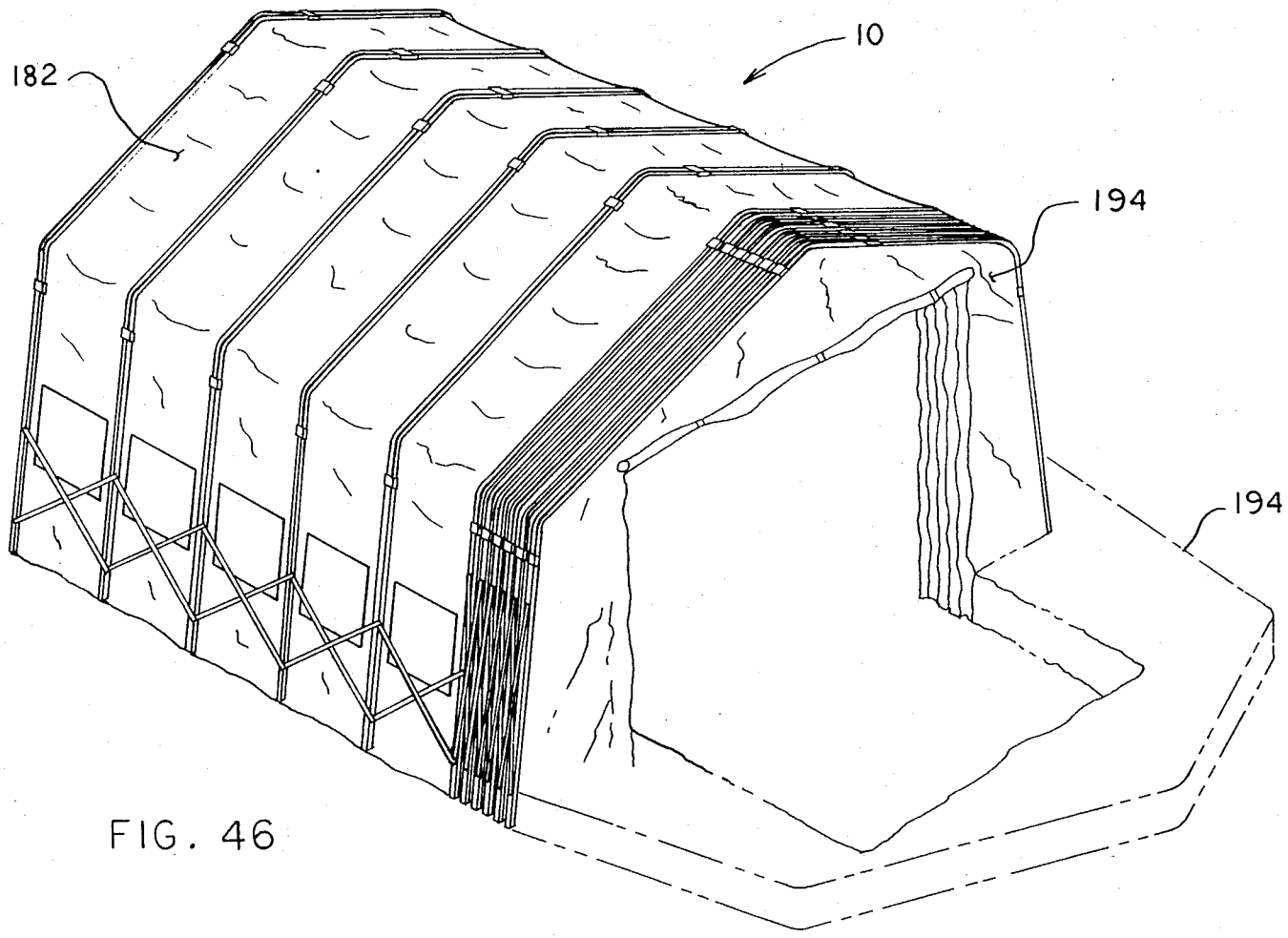
FIG. 46 shows a perspective view of one half-shelter in the fully extended position and a second half-shelter in standing position and attached to the first half-shelter, ready to be extended.

As shown in FIG. 46, the second (mating) half-shelter 194 is prepared by repeating the procedure illustrated in FIGS. 41, 42, and 43. The legs of the mating half-shelter should be positioned about 3 feet from the front leg of the extended half-shelter (as shown in phantom) so as to cause no restriction when the mating half-shelter 194 is raised. The mating half-shelter 194 is then raised as illustrated in FIG. 44 and fully extended as illustrated in FIG. 45. The two halves 182 and 194 of the shelter 10 are then latched together with shelter connectors 64 and weather seal 70, as illustrated in FIGS. 17 and 18, and covered with a joint cover 72 (see FIG. 1). Lastly, shelter 10 is staked down with guy ropes 20 and stakes 22 as shown in FIG. 1. To strike the shelter, the above described procedures are reversed.

Figure 47:
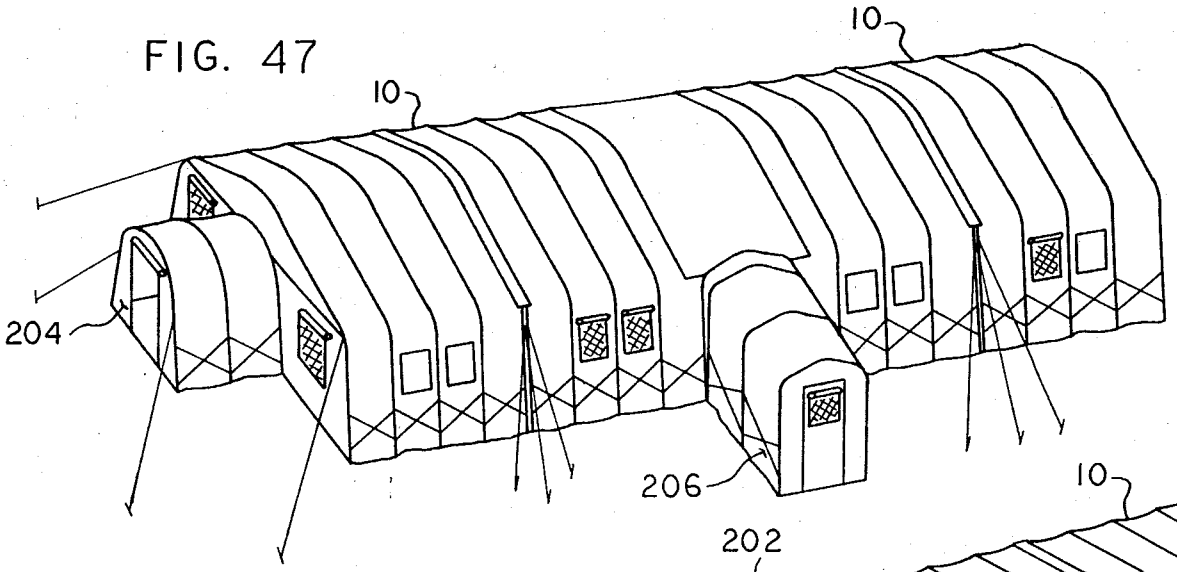
FIG. 47 is a perspective view showing two large or medium sized shelters connected together with an end-to-end connector and equipped with a vestibule on one end and one side.

To erect and operate a small shelter 100 (see FIG. 47) is similar but even simpler than described above for a large-sized shelter 10. The shelter 100 is carried or transported in the folded position in a zipper carrying bag (not shown). In this configuration, the shelter makes a surprisingly compact and easy to handle semicircular package. To erect the shelter, the zipper bag is removed and the shelter 100 laid flat on the ground. The shelter legs are the extended into place. Next, the shelter is raised to the vertical position ready for extension. Then, two men grasp the shelter, one on either side, and simply walk it out to its fully extended position. Lastly, guy ropes along the sides and ends of the shelter are staked down. The whole procedure takes five minutes or less for a small shelter 20 feet long and 11 feet wide. By contrast, a medium sized shelter about 32 feet long and 20 feet wide may be deployed or struck in ten minutes by four persons. A large maintenance shelter 42 feet long and 22 feet wide may be deployed or struck in fifteen minutes by six persons.

Large or medium sized shelters 10 have been shown thus far in this application as single free-standing shelters. However, as will be explained, the invention also includes a method and arrangement for connecting a plurality of shelters 10 together into groups of shelters or shelter complexes which may comprise any practical number of shelters 10. Looking now at FIG. 47, two shelters 10 may be erected and positioned in a row 200 so that they may be connected by an end-to-end connector 202. Row 200 has also a vestibule 204 connected at one end and a vestibule 206 connected to the side of end-to-end connector 202. Vestibules 204 and 206 prevent rain from entering the shelter 10 and, as previously explained for the triangular vestibules shown in FIG. 3 to 3*d*, the vestibules make the shelter usable under blackout conditions. A person entering the vestibule 204 or 206 may close the outer door before opening the inner door, thus preventing any light from escaping from the shelter.

Figure 48:
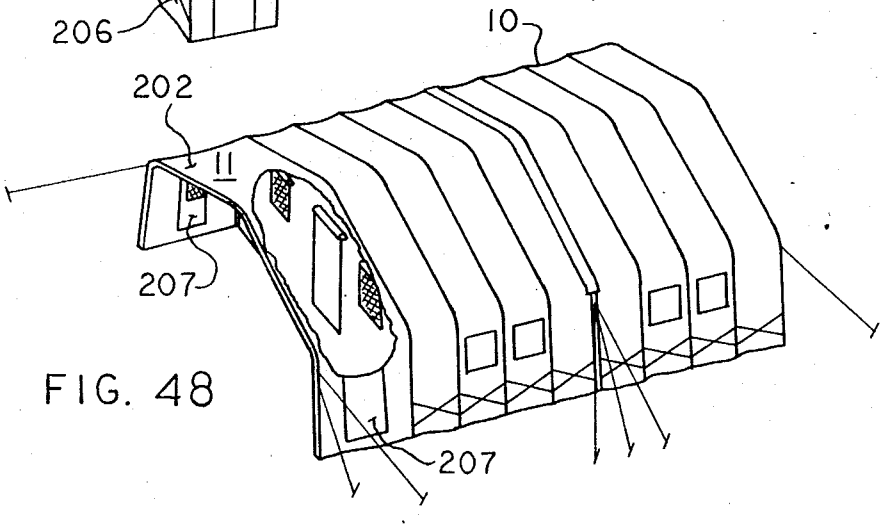
FIG. 48 is a perspective view of a large or medium sized shelter with an end-to-end connector on one of its ends.

FIG. 48 shows a shelter 10 with an end-to-end connector 202 attached to one of its ends. Connector 202 has two ribs 12 of the type used in shelter 10 and a single panel of fabric 11 attached to its ribs 12. As may be seen, connector 202 has no ends but does have two doors 207, one on either side. Connector 202 is attached to the end of shelter 10 by use of a plurality of shelter connectors 64 (see FIG. 17 and 18).

Figure 49:
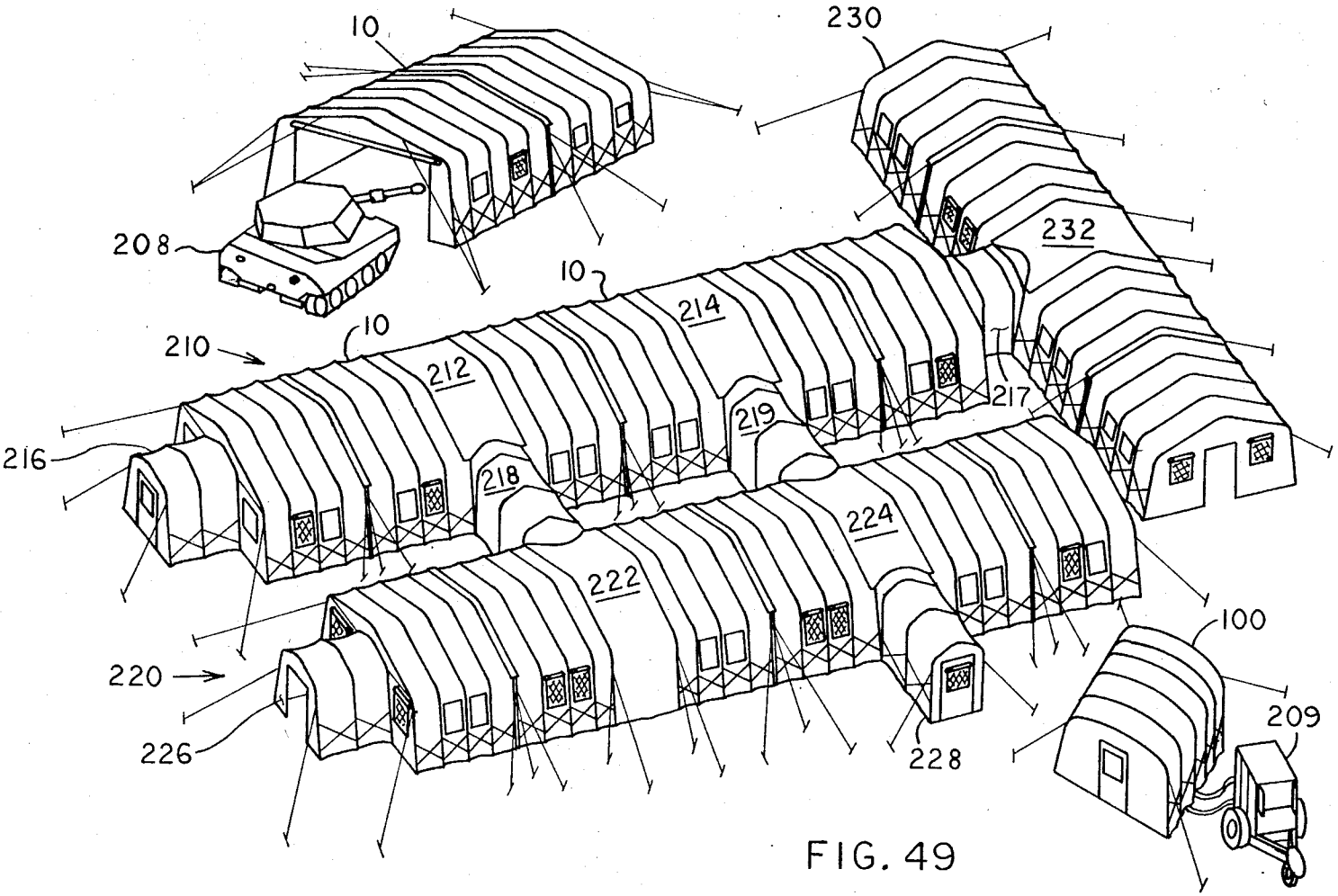
FIG. 49 is a perspective view showing how a plurality of large or medium sized shelters can be arranged in a large connected complex.

FIG. 49 shows how large or medium sized shelters 10 can be arranged in a large connected complex suitable for a large field hospital or a high level military headquarters. At the upper left, a large shelter 10 is shown being used as a maintenance shelter for a tracked vehicle 208. As shown in the lower right, a small sized shelter 100, connected to a generator 209 may be used as small personnel quarters or as an operations type shelter.

The large complex in FIG. 49 has three shelters 10 aligned in a first row 210 with their mating ends connected together by two end-to-end connectors 212 and 214. Each shelter 10 comprises two mating shelter halves, as illustrated in FIG. 1 or FIG. 3*c*, which are connected together by a plurality of shelter connectors 64 (see FIG. 17 and 18). The joint between shelter halves is equipped with a weather seal 70 and a joint cover 72 (see FIG. 1). Vestibules 216 and 217 and side vestibules 218 and 219 are attached to the first row of shelters 210.

A second row 220 of three aligned shelters 10 is parallel to first row 210. Shelters 10 in the second row 220 are also connected together by two end-to-end connectors 222 and 224. Row 220 of shelters 10 also has an end vestibule 226 and a side vestibule 228.

A third row 230 of aligned shelters 10 is perpendicular to first row 210 and is connected to row 210 by vestibule 217. Third row 230 comprises two shelters 10 which are connected together by end-to-end connector 232.

For purposes of illustration of the possibilities and usefulness of the invention, a particular configuration is shown comprising two parallel rows 210 and 220 of three shelters 10 each aligned end-to-end, connected at their sides by two vestibules 218 and 219, and further comprising a third row 230 of two aligned shelters, connected end-to-end, and with its side connected by vestibule 217 to the end of the first row 210 of shelter 10. However, the number of variables in arranging a shelter complex is endless. Once it is understood that the number of rows can be varied, the number of shelters in each row can be varied, the number of vestibules attached to either the ends of shelters or to the sides of end-to-end connectors can be varied, and that a row of shelters can be attached to other rows of shelters with its main axis either parallel or perpendicular to the other rows of shelters, then it will also be understood that the number of permutations and combinations of arrangements of shelter complexes which are within the scope of the invention is infinite.

Figure 50:
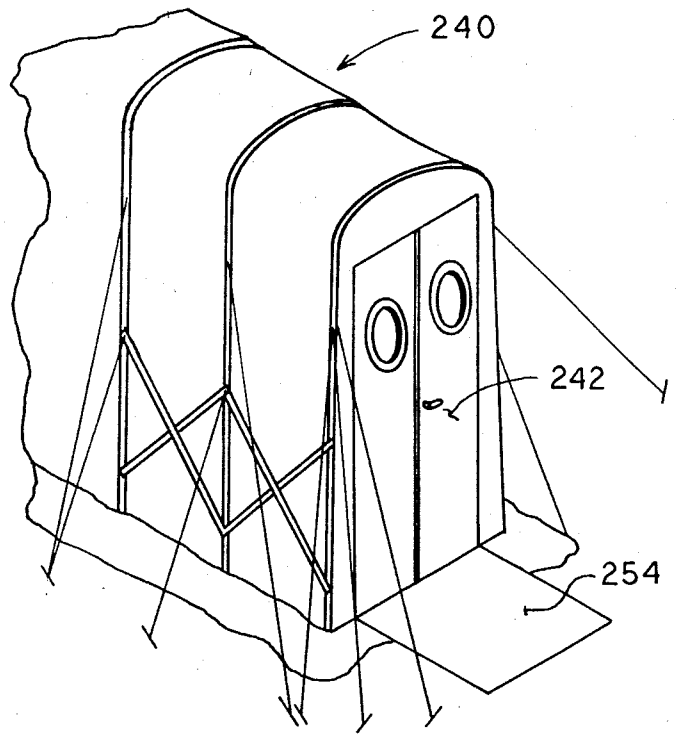
FIG. 50 is a perspective view showing details of a vestibule.
Figure 51:
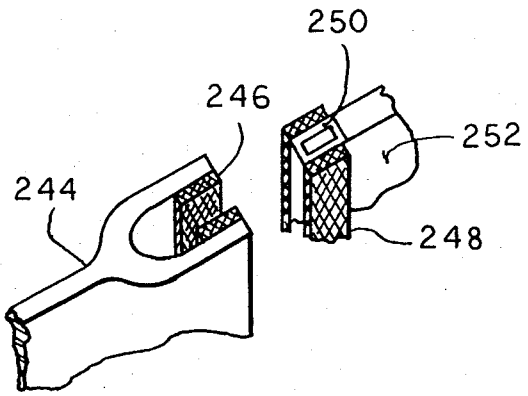
FIG. 51 is a perspective view showing how the vestibule doors of FIG. 50 are mounted using hook and pile fastener tape.

The vestibule 240 shown in FIG. 50 is an entranceway to the front of a shelter or to the side of an end-to-end connector or serves as a corridor between two end-to-end connectors. Vestibule 240 can either have a soft fabric doorway which rolls up, such as is shown on the front end of the shelter of FIG. 3*c*, or it may have a set of hardwall doors 242 which swing open on hinges. The vestibule 240 is built so that either a soft wall or hard wall door can be inserted into the vestibule's fastener tape "Y" connection 244 shown in FIG. 51. This "Y" configuration 244, which is permanently a part of the fabric attached to the vestibule, consists of fabric with pile fastener tape 246 sewn on both legs of the "Y." The doorway has hook fastener tape 248 attached to both the front and the back of the door edge 250. Thus, when the door 252 is inserted into the "Y" connection, it has a weather tight seal along both sides and the top.

The hard wall doors 252 are preferably constructed of a honeycomb material which is both lightweight and rigid. The door edges 250 are an aluminum tubing framework, which provides a good surface to which hook fastner tape 248 can be bonded, and is also stiff enough to provide a substantial hinge as it pivots about the edge of the "Y" connection 244. A ramp 254 is provided at both the front and back of doors 242 to allow carts with wheels to ride smoothly over the doorway frame bottom. These ramps 254 fold up when striking the shelter so that they lie flush with the door's surface.

Several additional features of shelter 10 have been incorporated into the design. A liner, preferably made of spun bonded or other moisture-repelling material and preferably white or light in color, has been added to resist condensation and insulate the inside of the shelter. Air conditioning ducts have been incorporated into the liner material to allow air currents to be distributed evenly throughout the shelter. Third, window openings have been equipped with clear plastic windows, window screens, and an opaque flap to provide options for outside light, ventilation, or blackout, as desired.

As herein described, the present invention provides a greatly improved expandable utility structure which is lighter in weight, easier to manufacture, and easier to repair than the Cummins shelter, or any other shelter previously known. Double grooves have been placed in opposite sides of the aluminum extrusion ribs for easy and fast detachment of the shelter's fabric material to and from the folding frame. Also, the extruded ribs provide a hidden folding bar and slide system when the shelter is folded, thus eliminating protruding bolts, nuts, washers, and metal bars present on some prior art shelters. The present invention may utilize either a single reinforcing member or X-shaped braces between adjacent ribs on each side of the frame. Next, a newly designed hinge is sturdier, longer lasting, and more foolproof than any hinges shown on known prior art devices. The new hinge has no protruding bolts, nuts, or washers which might tear the fabric and cause maintenance problems. A newly designed shelter connector solves the problem of connecting two shelters together after erection and facilitates the building of shelter complexes. Shelters may be grouped into large connected complexes by building rows of shelters with their ends connected by the use of end-to-end connectors and by connecting parallel and perpendicular rows of shelters through the use of tunnel-like vestibules which attach to the sides of the end-to-end connectors or to the ends of rows of shelters. The improved expandable shelter includes hardware allowing a fly cover to be quickly added to the shelter at any time, thereby providing additional protection from the sun and making the shelter cooler. The invention also includes methods of erecting and striking the shelters and an arrangement for grouping the shelters into shelter systems or complexes.

We claim:

1. An expandable utility shelter which is designed to be quickly erectable and quickly strikable and foldable comprising:

support means comprising a plurality of parallel structural rib members disposed in a longitudinal interconnected column, each said rib member being an inverted U-shaped element, each leg of each said rib member incorporating at least one hinge means operative to permit said leg to be folded inwardly to provide a compact shelter for purposes of storage or easy transportation;

a force transmitting means exterior to said ribs comprising:

a series of single, straight reinforcing members connecting said ribs arranged so that one said single, straight reinforcing member connects each pair of adjacent ribs on each side of said shelter, said reinforcing members being operative to push said rib members together in abutting relationship or to pull them apart in spaced relationship and to stabilize and maintain parallel physical relationship between said rib members; and a plurality of pivot pins, each pin passing through one end of one of said reinforcing members and also passing through one said rib member, for pivotally attaching said one end of said one reinforcing member to said one rib; and sliding means pivotally attached to the opposite end of said one reinforcing member for slidably and pivotally attaching said one reinforcing member to the next adjacent said rib member;

closure means comprising a flexible cover substantially coextensive with said support means, said cover secured to each said rib member on the interior side thereof and operable to pleat inwardly throughout its configuration; and a plurality of guy means attached to said ribs for holding down said shelter and applying tension to the cover of said shelter to help hold said shelter in its erected configuration;

whereby said cover is within and substantially protected by said rib members when in their folded abutting relationship and each pair of adjacent ribs on said shelter is connected by a total of two said straight reinforcing members.

2. The utility shelter of claim 1 wherein said sliding means comprises a slide assembly pivotally attached to said reinforcing member.

3. The expandable utility shelter of claim 1 wherein each said structural rib member comprises:

a one-piece ridge member which comprises the top portion of said rib member;

two arms, the first one of said arms being attached to one end of said ridge member, and the second one of said arms being attached to the opposite end of said ridge member; and two legs, each leg being attached to the lower end of one of said arms.

4. The expandable utility shelter of claim 3 wherein said arms are attached to said legs by hinge means.

5. The expandable utility shelter of claim 4 wherein said ridge members are attached to said arms by hinge means.

6. The expandable utility shelter of claim 5 wherein said hinge means are leaf hinges.

7. The expandable utility shelter of claim 6 wherein said cover comprises a plurality of separate panels, each said separate panel having elongated beads attached to its vertical sides.

8. The expandable utility shelter of claim 7 wherein said rib members have a rectangular cross section and have a first pair of adjacent channels in the inwardly-facing one of their exterior faces for receiving said beads attached to two adjacent panels of said cover.

9. The expandable utility shelter of claim 1 comprising a vestibule attached to at least one end of said shelter.

10. The expandable utility shelter of claim 9 wherein said vestibule comprises:

two swinging vestibule halves pivotally attached to the end of said shelter, each said vestibule half comprising a vestibule rib pivotally attached to the end ridge member portion of the end rib member of said shelter and a triangular cover attached to said vestibule rib and said end rib member; and a vestibule pivot attached to said top member for pivotally holding said two vestibule ribs.

11. The expandable utility shelter of claim 10 wherein said vestibule pivot is U-shaped and encloses the upper ends of said vestibule ribs on three sides.

12. The expandable utility shelter of claim 11 comprising two pins passing through said vestibule pivot, each pin serving to pivotally attach the upper end of one of said vestibule ribs to said vestibule pivot.

13. The expandable utility shelter of claim 12 comprising latch means to hold said two vestibule ribs together when said shelter is in the erected position.

14. The expandable utility shelter of claim 13 comprising a door in each said vestibule half, each said door having a window, a screen covering for said window, and a rain flap for said window.

15. An expandable utility shelter which is designed to be quickly erectable and quickly strikable and foldable comprising:

support means comprising a plurality of parallel structural rib members disposed in a longitudinal interconnected column, each said rib member being an inverted U-shaped element, each leg of each said rib member having a substantially vertical channel in one of its sides, each said leg incorporating at least one hinge means operative to permit said legs to be folded inwardly to provide a compact shelter for purposes of storage or easy transportation;

a force transmitting means exterior to said ribs comprising:

a series of single, straight reinforcing members connecting said ribs arranged so that one said single, straight reinforcing member connects each pair of adjacent ribs on each side of said shelter, said reinforcing members being operative to push said rib members together in abutting relationship or to pull them apart in spaced relationship and to stabilize and maintain parallel physical relationship between said rib members; and a plurality of pivot pins, each pin passing through one end of one of said reinforcing members and also passing through one said rib member, for pivotally attaching said one end of said one reinforcing member to said one rib; and sliding means comprising a slide assembly pivotally attached to the opposite end of said one reinforcing member for slidably and pivotally attaching said one reinforcing member to the next adjacent said rib member, said slide assembly comprising a slide attached to a threaded stud, said slide being operative to move along said vertical channel in said next adjacent rib member;

closure means comprising a flexible cover substantially coextensive with said support means, said cover secured to each said rib member on the interior side thereof and operable to pleat inwardly throughout its configuration; and a plurality of guy means attached to said ribs for holding down said shelter and applying tension to the cover of said shelter to help hold said shelter in its erected configuration;

whereby said cover is within and substantially protected by said rib members when in their folded abutting relationship and each pair of adjacent ribs on said shelter is connected by a total of two said straight reinforcing members.

16. The utility shelter of claim 15 wherein said flexible cover comprises beads attached to said cover, and said plurality of parallel structural rib members support said shelter including said cover and wherein each of said rib members comprises 2 leg sections, 2 arm sections, and 1 ridge section and wherein said arm sections and said ridge section are generally rectangular in cross section with two side faces, an inward face, and an outward face and have double channels in said inward face to receive said beads for attachment of said cover to said rib members and wherein said two side faces and said outward face are closed, flat surfaces.

17. The utility shelter of claim 16 wherein said arm sections and said ridge members of said ribs have a closed hollow portion inside and adjacent to said outward face.

18. The utility shelter of claim 17 wherein said flexible cover comprises a plurality of separate rectangular panels, each said panel having beads attached to said panel along the longest sides of said panel, and said leg sections of said rib members being generally rectangular in cross section with 2 side faces, an inward face and an outward face and having double channels in each of said inward and outward faces for attachment of said cover panels to said leg sections of said rib members.

19. The utility shelter of claim 18 wherein said leg sections of said rib members have a partially closed channel in one said side face to lock in said reinforcing member slide and an open channel in the other said side face to attach the fixed end of a said single reinforcing member.

20. The utility structure of claim 19 having shelter connector means mounted at each end of the shelter for connecting a plurality of shelters together end to end, said connector means comprising a one-piece bracket comprising two inverted U-shaped brackets connected together by a center bar, said one-piece bracket having two threaded ends, said one-piece bracket comprising two nuts attached to said threaded ends, whereby said connector means may hang over the end rib of one shelter and be bolted to the end rib of the next adjacent shelter.

21. An expandable utility shelter comprising:

support means comprising a plurality of parallel structural rib members disposed in a longitudinal interconnected column, each said rib member being an inverted U-shaped element, each leg of each said rib member incorporating at least one hinge means operative to permit said leg to be folded inwardly to provide a compact shelter for purposes of storage or easy transportation, said hinge means comprising a cast hinge having two identical flat leaves and a hinge pin, each leaf having two identical, substantially circular, spaced projections attached to said leaf at an obtuse angle with the plane of said first leaf, each said projection having a circular opening at its center sized to receive said hinge pin, said projections on each of said two leaves arranged to mesh so as to provide a plurality of aligned bearing surfaces to receive said hinge pin;

force transmitting means exterior to said ribs comprising a series of single, reinforcing members connecting said ribs arranged so that one single reinforcing member connects each pair of adjacent ribs on each side of said shelter, said reinforcing members being operative to push said rib members together in abutting relationship or to pull them apart in spaced relationship and to stabilize and maintain parallel physical relationship between said rib members, each said reinforcing member being fixed to one rib and attached to the next adjacent rib by sliding means, said sliding means comprising a slide assembly pivotally attached to said reinforcing member, said slide assembly comprising a slide attached to a threaded stud, said slide being operative to move along a substantially vertical channel in said next adjacent rib, each said reinforcing member being fixed at one end to one rib and fixed at its opposite end to an adjacent rib, said reinforcing member having two separate legs which are pivoted at the center of said reinforcing member so that said legs of said reinforcing member may be folded, the first of said two separate legs of said reinforcing member having a U-shaped cross section and being slightly larger than the second of said separate legs so that said second leg will fold inside said first leg;

closure means comprising a flexible cover substantially coextensive with said support means, said cover being secured to each said rib member on the interior side thereof and operable to pleat inwardly throughout its configuration, said flexible cover comprising:

beads attached to said cover, said rib members having a channel in at least one side of each of said rib members to receive said beads for attachment of said cover to said rib members; and a plurality of separate rectangular panels, each said panel having beads attached to said panel along the longest sides of said panel, and said rib members having double channels in at least one side of each of said rib members for attachment of said cover panels to said rib members; and shelter connector means mounted at each end of the shelter for connecting a plurality of shelters together end-to-end, said connector means comprising a plurality of fixtures bolted to one end rib of one said shelter and hooked over the end rib of an adjacent shelter;

whereby said cover is within and substantially protected by said rib members when in their folded abutting relationship.

22. The utility shelter of claim 21 wherein said shelter connector means comprises a plurality of fixtures which are U-shaped when viewed from above and are also U-shaped when viewed from the side, the tips of each of the U-shaped fixtures being bolted to the end rib of one said shelter, and the opposite end of the U-shaped fixture being hooked over the end rib of the adjacent shelter.

23. An expandable utility shelter comprising:

support means comprising a plurality of parallel structural rib members disposed in a longitudinal interconnected column, each said rib member being an inverted U-shaped element, each leg of each said rib member incorporating at least one hinge means operative to permit said leg to be folded inwardly to provide a compact shelter for pusposes of storage or easy transportation, said hinge means comprising a channel-shaped hinge cover open on one side, a bolt extending through said hinge cover, and a section of said rib member which is pivoted around said bolt and fits into said hinge cover, said section of said rib member having a latch slidably attached to it for securely latching said hinge means, said hinge cover having an open slotted channel cut into its side which is opposite its open side, and said section of a rib member having a closed slotted channel cut into its side which pivots against said hinge cover, said latch cover being movably mounted in said closed slide channel;

a force transmitting means exterior to said ribs comprising a series of single reinforcing members connecting said ribs arranged so that one single reinforcing member connects each pair of adjacent ribs on each side of said shelter, said reinforcing members being operative to push said rib members together in abutting relationship or to pull them apart in space relationship and to stabilize and maintain parallel physical relationship between said rib members, each said reinforcing member being fixed to one rib and attached to the next adjacent rib by sliding means; and closure means comprising a flexible cover substantially coextensive with said support means, aid cover secured to each said rib member on the interior side thereof and operable to pleat inwardly throughout its configuration;

whereby said cover is within and substantially protected by said rib members when in their folded abutting relationship.

24. The utility shelter of claim 23 wherein said slide latch moves in both said slotted channels when said section of said rib member is pivoted into said hinge member to securely latch said hinge means.

25. An expandable utility shelter with a support framework comprising:

a plurality of inverted U-shaped structural rib members aligned in a parallel relationship, each said structural rib member comprising:

a ridge member;

two arms, the first one of said arms being attached by leaf hinges to one end of said ridge member, and the second one of said arms being attached by leaf hinges to the opposite end of said ridge member; and two legs, each leg being attached by leaf hinges to the lower end of one of said arms;

a series of single reinforcing members, one single reinforcing member connecting each pair of adjacent ribs on each side of said shelter, said reinforcing members being attached to said rib members so that they are substantially horizontal when the shelter is expanded, and said reinforcing members are substantially vertical when the shelter is closed, each said reinforcing member being pivotally attached to one rib and comprising a slide attached to the next adjacent rib; and a flexible cover attached to said rib members and arranged so that said cover pleats inwardly when said shelter is closed, said cover comprising a plurality of separate panels, each said separate panel having elongated beads attached to its vertical sides; and wherein:

a. said rib members have a rectangular cross section and have a first pair of adjacent channels in one of their exterior faces for receiving said beads attached to two adjacent panels of said cover;

b. said legs of said rib members have a second pair of adjacent channels in a second exterior face directly opposite to said first pair of adjacent channels, whereby said legs are interchangeable and may be used on either side of said shelter; and c. said legs of said rib members have single channels in their third and fourth exterior faces, said channel in said third exterior face being configured to receive one of said reinforcing members when the shelter is closed, and said channel in said fourth exterior face being configured to receive said slide.

26. The expandable utility shelter of claim 25 wherein said shelter comprises a plurality of U-shaped latches for fastening two shelters together end-to-end.

27. The expandable utility shelter of claim 26 wherein said rib members are equipped with a plurality of eave extenders for supporting a fly cover above the roof of said shelter.

28. An expandable utility shelter comprising:

a supporting framework comprising:

a plurality of parallel U-shaped structural rib members aligned in a longitudinal interconnected column, each said rib member comprising a ridge member; two arms, the first of said arms being attached to one end of said ridge member and the second arm being attached to the opposite end of said ridge member; and two legs, each leg being attached to the lower end of one of said arms;

a plurality of leaf hinges for connecting said top member to said arm members and the opposite ends of said arm members to said leg members;

a plurality of X-shaped braces, said braces connecting each adjacent pair of said rib members on each side of said shelter, said braces comprising two elongated members pivotally connected together at their midpoints, each said elongated member having its lower end pivotally connected to one of said pair of adjacent rib members and having its upper end movably connected to the other one of said pair of adjacent rib members, said plurality of X-shaped braces being operative to push said rib members together in abutting relationship when said shelter is closed or to pull them apart in spaced relationship when said shelter is opened and to stabilize and maintain a parallel physical relationship between said rib members;

a flexible cover removably secured to each said rib member on the side thereof facing the interior of said shelter and arranged to pleat inwardly between each pair of adjacent ribs;

a vestibule attached to at least one end of said shelter, said vestibule comprising:

said vestibule comprising:

two swinging vestibule halves pivotally attached to the end of said shelter, each of said vestibule halves comprising a vestibule rib pivotally attached to the end ridge member portion of the end rib member of said shelter and a triangular cover attached to said vestibule rib and said end rib member; and a vestibule pivot attached to said top member for pivotally holding said two vestibule ribs, said vestibule pivot being U-shaped and enclosing the upper ends of said vestibule ribs on three sides;

two pins passing through said vestibule pivot, each pin serving to pivotally attach the upper end of one of said vestibule ribs to said vestibule pivot;

latch means to hold said two vestibule ribs together when said shelter is in the erected position;

a door in each said vestibule half, each said door having a window, a screen covering for said window, and a rain flap for said window; and wherein:

a. said cover comprises a plurality of separate panels, each said separate panel having elongated beads attached to its vertical sides;

b. said legs of said rib members have a rectangular cross section and have a first pair of adjacent channels on their exterior side which faces the interior of said shelter, for receiving said beads attached to two adjacent panels of said cover; and c. said shelter comprises a plurality of U-shaped latches for fastening two shelters together end-to-end.

29. The expandable utility shelter of claim 28 wherein said rib members are equipped with a plurality of eave extenders for supporting a fly cover above the roof of said shelter.

30. An expandable utility shelter which is designed to be quickly erectable and quickly strikable and foldable comprising:

support means comprising a plurality of parallel structural rib members disposed in a longitudinal interconnected column, each said rib member being an inverted U-shaped element, each leg of each said rib member incorporating at least one hinge means operative to permit said leg to be folded inwardly to provide a compact shelter for purposes of storage or easy transportation, each said hinge means comprising a channel-shaped hinge cover open on one side and having a slot cut in the side of said hinge cover opposite said open side, said slot being open at the top end and closed at the bottom end, a bolt extending through said hinge cover, and a section of said rib member which is pivoted around said bolt and fits into said hinge cover, said section of said rib member having a latch with an I-shaped cross sectional area slidably attached to it for sliding said latch downward in said hinge cover slot and securely latching said hinge means;

a force transmitting means exterior to said ribs comprising:

a series of single, straight reinforcing members connecting said ribs arranged so that one said single, straight reinforcing member connects each pair of adjacent ribs on each side of said shelter, said reinforcing members being operative to push said rib members together in abutting relationship or to pull them apart in spaced relationship and to stabilize and maintain parallel physical relationship between said rib members;

a plurality of pivot pins, each pin passing through one end of one of said reinforcing members and also passing through one said rib member, for pivotally attaching said one end of said one reinforcing member to said one rib; and sliding means pivotally attached to the opposite end of said one reinforcing member for slidably and pivotally attaching said one reinforcing member to the next adjacent said rib member;

closure means comprising a flexible cover substantially coextensive with said support means, said cover secured to each said rib member on the interior side thereof and operable to pleat inwardly throughout its configuration; and a plurality of guy means attached to said ribs for holding down said shelter and applying tension to the cover of said shelter to help hold said shelter in its erected configuration;

whereby said cover is within and substantially protected by said rib members when in their folded abutting relationship and each pair of adjacent ribs on said shelter is connected by a total of two said straight reinforcing members.

31. An expandable utility shelter with a support framework comprising:

a plurality of inverted U-shaped structural rib members aligned in a parallel relationship, each said structural rib member comprising:

a one-piece ridge member which comprises the top portion of said ridge member;

two arms, the first one of said arms being attached by leaf hinge means to one end of said ridge member, and the second one of said arms being attached by leaf hinge means to the opposite end of said ridge member; and two legs, each leg being attached by leaf hinge means to the lower end of one of said arms;

wherein said rib members have a rectangular cross section and have a first pair of adjacent channels in the inwardly-facing one of their exterior faces for receiving said beads attached to two adjacent panels of said cover and wherein said legs of said rib members have a second pair of adjacent channels in a second, outwardly-facing exterior face directly opposite to said first pair of adjacent channels, whereby said legs are interchangeable and may be used on either side of said shelter;

a series of single reinforcing members, one single, straight reinforcing member connecting each pair of adjacent ribs on each side of said shelter, said reinforcing members being attached to said rib members so that they are substantially horizontal when the shelter is expanded, and said reinforcing members are substantially vertical when the shelter is closed, each said reinforcing member being pivotally attached to one rib member and comprising a slide attached to the next adjacent rib member; and a flexible cover attached to said rib members and arranged so that said cover pleats inwardly when said shelter is closed, said cover comprising a plurality of separate panels, each said separate panel comprising elongated beads attached to its vertical sides;

whereby each pair of adjacent ribs on said shelter is connected by a total of two said straight reinforcing members.

* * * * *